US011053609B2

(12) United States Patent
Ou et al.

(10) Patent No.: US 11,053,609 B2
(45) Date of Patent: Jul. 6, 2021

(54) GRAPHENE COMPOSITE ULTRA-HIGH MOLECULAR WEIGHT POLYETHYLENE FIBER AND PREPARATION METHOD THEREOF

(71) Applicant: JIANGSU HANVO SAFETY PRODUCT CO., LTD, Jiangsu (CN)

(72) Inventors: Chonghua Ou, Jiangsu (CN); Shendong Ren, Jiangsu (CN); Ming Zhang, Jiangsu (CN); Xianhua Wang, Jiangsu (CN)

(73) Assignee: JIANGSU HANVO SAFETY PRODUCT CO., LTD, Jiangsu (CN)

( * ) Notice: Subject to any disclaimer, the term of this patent is extended or adjusted under 35 U.S.C. 154(b) by 0 days.

(21) Appl. No.: 17/010,469

(22) Filed: Sep. 2, 2020

(65) Prior Publication Data

US 2020/0399787 A1 Dec. 24, 2020

Related U.S. Application Data

(62) Division of application No. 16/149,536, filed on Oct. 2, 2018, now abandoned.

(30) Foreign Application Priority Data

Jan. 8, 2018 (CN) ..... 201810014733.9

(51) Int. Cl.
*D01F 8/06* (2006.01)
*D01F 1/10* (2006.01)
(Continued)

(52) U.S. Cl.
CPC ..... *D01D 1/02* (2013.01); *D01D 5/088* (2013.01); *D01F 1/10* (2013.01); *D01F 6/04* (2013.01);
(Continued)

(58) Field of Classification Search
None
See application file for complete search history.

(56) References Cited

U.S. PATENT DOCUMENTS 5,332,698 A 7/1994 Nyssen et al.
2007/0231572 A1* 10/2007 Tam ..... C08J 3/091 428/364
(Continued)

FOREIGN PATENT DOCUMENTS

CN 102037169 A 4/2011
CN 102828312 A 12/2012
(Continued)

OTHER PUBLICATIONS

Machine translation of CN 106149085 B, google patents, 18 pages. (Year: 2021).*
(Continued)

*Primary Examiner* — Xiao S Zhao
*Assistant Examiner* — Emmanuel S Luk
(74) *Attorney, Agent, or Firm* — Novick, Kim & Lee, PLLC; Allen Xue

(57) ABSTRACT

The present invention provides a composite ultra-high molecular weight polyethylene fiber and a preparation method thereof, wherein the method comprises mixing glass fiber, graphene slurry, UHMWPE powder and white oil, and then swelling to a molten state, then cooling into a gel-spun, and finally making the fiber from the gel-spun. The method of the present disclosure not only can solve the problem that the glass fiber has poor dispersibility in the case of high viscoelasticity of the ultra-high molecular weight polyethylene, but also can improve the cut resistance of the ultra-high molecular weight polyethylene fiber on the basis of ensuring the flexibility of the yarn.

15 Claims, 8 Drawing Sheets

(51) Int. Cl.

| | |
|---|---|
| ***D01F 6/04*** | (2006.01) |
| ***D01D 1/02*** | (2006.01) |
| ***D01D 5/088*** | (2006.01) |
| ***D01F 9/08*** | (2006.01) |

(52) U.S. Cl.
CPC ..... *D01F 8/06* (2013.01); *D01F 9/08* (2013.01); *D10B 2401/063* (2013.01)

(56) References Cited

U.S. PATENT DOCUMENTS

| | | | | |
|---|---|---|---|---|
| 2008/0305331 | A1* | 12/2008 | Tam | B29C 48/405 428/374 |
| 2017/0058431 | A1* | 3/2017 | Shen | D01D 1/02 |
| 2018/0363168 | A1* | 12/2018 | Zhang | D01D 5/04 |
| 2019/0185596 | A1* | 6/2019 | Li | B29C 48/09 |

FOREIGN PATENT DOCUMENTS

| | | | |
|---|---|---|---|
| CN | 105970331 | A | 9/2016 |
| CN | 106149085 | A | 11/2016 |
| CN | 106222781 | A | 12/2016 |
| CN | 107326462 | A | 11/2017 |
| JP | 200419050 | A | 1/2004 |
| JP | 2007119931 | A | 5/2007 |
| WO | 2006010521 | A | 2/2006 |
| WO | 2006010521 | A1 | 2/2006 |
| WO | 2008046476 | A1 | 4/2008 |

OTHER PUBLICATIONS

Machine translation of Cn 106222781 B, google patents, 21 pages. (Year: 2021).*

White Oils, https://oilproducts.eni.com/en_GB/products/industrial-lubricants/white-oils, 3 pages. (Year: 2021).*

What is a white oil?, https://www.lubricants.total.com/what-white-oil, 2 pages. (Year: 2021).*

"What is UHMW Polyethylene Plastic and What is it Used For?", Acme Plastics, https://www.acmeplastics.com/content/what-is-uhmw-polyethylene-plastic-and-what-is-it-used-for/, 6 pages. (Year: 2019).*

MC Sobeiraj, CM Rimnac, "Ultra High Molecular Weight Polyethylene: Mechanics, Morphology, and Clinical Behavior", J Mech Behav Biomed Materials, PMC Mar. 18, 2013, 23 pages. (Year: 2009).*

* cited by examiner

GRAPHENE COMPOSITE ULTRA-HIGH MOLECULAR WEIGHT POLYETHYLENE FIBER AND PREPARATION METHOD THEREOF

TECHNICAL FIELD

The present invention relates to a composite ultra-high molecular weight polyethylene fiber and a preparation method thereof, and belongs to the technical field of high performance fibers.

BACKGROUND

Ultra-high molecular weight polyethylene (UHMWPE) fiber is also known as ultra-high strength polyethylene (UHMWPE) fiber, ultra-high modulus polyethylene (UHMWPE) fiber. Due to its unrivaled ultra-high tensile strength, UHMWPE can be used to produce fibers with ultra-high modulus of elasticity and strength by gel spinning, and the resulting fibers have a tensile strength of up to 3-3.5 Gpa, and a tensile elastic modulus of up to 100-125 GPa; and the fiber strength of which is the highest of all fibers that have been commercialized to date, 4 times larger than carbon fiber, 10 times larger than steel wire, and 50% larger than aramid fiber. It is widely used in military equipment, aerospace, marine operations, sports equipment and other fields.

The patents for improving the cut resistance of the fiber include CN102828312A, JP2004-19050, WO2008/046476, CN102037169A, etc., wherein high-strength fibers such as high molecular weight polyethylene and high-symmetric polyamide are coated with inorganic metal or glass fiber. However, due to the addition of a hard material such as an inorganic metal or a glass fiber, the body feels hard and the wearing is not comfortable. Graphene has good mechanical properties and self-lubricating properties, and can be coated on the surface of hard materials to increase its lubricity and make up for their shortcomings. However, if the graphene powder is directly added during the spinning mixture, the graphene is agglomerated in a large amount, and a spinning mixture with poor dispersibility is obtained. In composite materials, the dispersion of the reinforcing phase in the matrix has a crucial influence on the properties of the material. The experiment verified that if the graphene powder was directly added during the spinning mixture, the graphene was unevenly dispersed, which would affect the cutting performance of the final product, wherein the graphene particles have a wide particle size distribution, and the size is large and the agglomeration is serious, and thus it is difficult to form an effective interface with white oil. The uniformity and stability of graphene dispersion are poor, resulting in a short shelf life of the spinning mixture.

The technical content listed in the prior art is only representative of the technology possessed by the inventors, and is not taken as a prior art to evaluate the novelty and inventiveness of the present invention.

SUMMARY OF THE INVENTION

One object of the present invention is to provide a composite ultra-high molecular weight polyethylene fiber homogeneously dispersed with glass fiber and graphene for the deficiencies of the prior art.

Another object of the present invention is to provide a method for preparing the above composite ultra-high molecular weight polyethylene fiber.

The objects of the present invention are specifically achieved by the following technical solutions:

A preparation method of a composite ultra-high molecular weight polyethylene fiber comprises mixing glass fiber, graphene slurry, UHMWPE powder and white oil and swelling to a molten state, and then cooling into a gel-spun, and finally forming a fiber from the gel-spun.

According to one aspect of the invention, the glass fiber accounts for 0.2 wt % to 10 wt % of the composite ultra-high molecular weight polyethylene fiber, and the graphene accounts for 0.01 wt % to 3 wt % of the composite ultra-high molecular weight polyethylene fiber.

According to one aspect of the invention, the glass fiber accounts for 1 wt % to 6 wt % of the composite ultra-high molecular weight polyethylene fiber, and the graphene accounts for 0.05 wt % of the composite ultra-high molecular weight polyethylene fiber.

Preferred embodiment of the above method for preparing the composite ultra-high molecular weight polyethylene fiber comprises:

Preparing a glass fiber premix: dispersing glass fiber in a first white oil to obtain the glass fiber premix;

Preparing a graphene slurry premix: grinding graphene slurry, filtering, then adding the filter residue to a second white oil, and then adding a first UHMWPE to the second white oil contained the graphene filter residue, heating the premix to a first temperature, raising the first temperature to a second temperature after the same was not bubbled, and maintaining the second temperature;

Preparing a spinning mixture: mixing the glass fiber premix, the graphene slurry premix, a second UHMWPE, an antioxidant, and a third white oil to obtain the spinning mixture;

Swelling and mixing the spinning mixture to form a molten state and extruding the spinning mixture which is in the molten state;

Cooling to form a gel-spun; and

Obtaining the composite ultra-high molecular weight polyethylene fiber from the gel-spun.

In the method of preparing the glass fiber premix, the mixture of the glass fiber and the white oil is stirred by an emulsifier, and some of the longer glass fibers will be cut, so that the aspect ratio of the glass fiber is more homogeneous, the homogenization effect is enhanced, and the subsequent plugging by spinning is avoided.

According to one aspect of the invention, the glass fiber premix contains 5-30 wt %, preferably 10-25 wt %, and most preferably 25 wt % of the glass fibers.

According to one aspect of the invention, the dispersing method for dispersing the glass fiber in the first white oil comprises: firstly pouring the glass fiber into the first white oil, premixing, and then stirring at a high speed with an emulsifier to form a homogeneous slurry.

The mixture of glass fiber and white oil is forced by mechanical action to pass through a narrow gap at a high speed. Under the action of hydromechanical effects, due to the great velocity gradient in the narrow gap between the rotor and the stator created by the high tangential speed generated by the high-speed rotation of the rotor creates, and the strong kinetic energy created by the high-frequency mechanical effect, the material is subjected to a synthetic action of strong hydraulic shearing, centrifugal extrusion, liquid layer friction, impact tearing and turbulence and the like in the gap between the stator and the rotor, so that the incompatible solid phase and liquid phase are homogeneously and finely dispersed and homogenized under the function of the additive, and then the dispersed phase particles or droplets are broken to achieve the purpose of homogeneous emulsification after high frequency circulation.

According to one aspect of the invention, the emulsifier has a stirring speed of 3000 rpm to 10000 rpm, preferably 3,500 rpm; and the stirring time is 5 min to 60 min, preferably 10 min to 30 min, and most preferably 15 min.

According to one aspect of the invention, the glass fiber has a diameter of 3 μm to 10 μm, preferably 5 μm to 7 μm; and/or the glass fiber has an average length of 30 μm to 100 μm, preferably 50 μm to 70 μm; and/or, the glass fiber has a length in the range of 10 μm to 600 μm, preferably from 50 μm to 400 μm.

According to one aspect of the invention, the glass fiber is previously modified with a coupling agent and then used to prepare the glass fiber premix. The specific treatment method is as follows: the coupling agent is dissolved in anhydrous ethanol, and then the glass fiber is added to mix homogeneously, impregnated, dried, ground, and filtered by 100 mesh.

According to one aspect of the invention, the coupling agent is added in an amount of from 0.1% to 3% by weight, preferably from 0.2% to 2% by weight, based on the total mass of the glass fiber.

According to one aspect of the invention, the immersion time of the glass fiber in the coupling agent ethanol solution is from 10 min to 5 h, preferably from 30 min to 2 h.

According to one aspect of the invention, the drying temperature is from 50° C. to 180° C., preferably from 80° C. to 130° C.; and the drying time is from 1 h to 6 h, preferably from 2 h to 3 h.

According to one aspect of the invention, the coupling agent is one or a mixture of two or more of silane coupling agents.

Wherein, the silane coupling agent is preferably one or a mixture of two or more of A-150, A-151, A-171, KH-550, KH-560, KH-570, KH-580, KH-590, KH-902 or KH-792. The A-150, A-151, A-171, KH-550, KH-560, KH-570, KH-580, KH-590, KH-902 or KH-792 are the grades of the silane coupling agents, and the performance of the different grades coupling agents is different. These grades are internationally recognized grades.

A silane coupling agent is a kind of low molecular organosilicon compound with special structure, and its general formula is $RSiX_3$, wherein R represents a reactive functional group having affinity or reactivity with a polymer molecule, such as oxyl, vinyl, epoxy, amide, aminopropyl group; X represents an alkoxy group capable of being hydrolyzed, such as halogen, alkoxy, acyloxy. During the coupling, the X group is first formed into a silanol, and then reacted with a hydroxyl group on the surface of the inorganic powder particles to form a hydrogen bond and further condensed into a —SiO-M covalent bond (M represents the surface of the inorganic powder particles). At the same time, the silanol of each molecule of the silane is associated with each other to form a network structure film covering the surface of the powder particles to organicize the surface of the inorganic powder.

The coupling agent A-150 is vinyl trichlorosilane, a colorless liquid, soluble in an organic solvent, and easily hydrolyzed and alcoholyzed. The coupling agent A-150 has a molecular formula of $CH_2{=}CHSiCl_3$, a molecular weight of 161.5, a boiling point of 90.6° C., and a density of 1.265 g/cm$^3$, which is suitable for glass fiber surface treatment agents and reinforced plastic laminate treatment agents.

The coupling agent A-151 is vinyl triethoxysilane with a molecular formula of $CH_2{=}CHSi(OCH_2CH_3)_3$, soluble in organic solvents, insoluble in water of pH=7, suitable for polymer such as polyethylene, polypropylene, unsaturated polyester, as well as glass fiber, plastic, glass, cable, ceramics, etc.

The coupling agent A-171 is vinyl trimethoxysilane with a molecular formula of $CH_2{=}CHSi(OCH_3)_3$, a colorless transparent liquid with a density of 0.95-0.99 g/cm$^3$, a refractive index of 1.38-1.40 and a boiling point of 123° C. It has the functions of coupling agent and cross-linking agent, and is suitable for polymer such as polyethylene, polypropylene, unsaturated polyester, and is commonly used in glass fiber, plastic, glass, cable, ceramic, rubber and so on.

The coupling agent KH-550 is γ-aminopropyltriethoxysilane, corresponding to the grade A-1100 (USA), has a density of 0.942 g/ml, a melting point of −70° C., a boiling point of 217° C., a refractive index of 1.42-1.422, and a flash point of 96° C. It is applied to mineral-filled thermoplastic and thermosetting resins such as phenolic, polyester, epoxy, PBT, polyamide, carbonate, which can greatly improve the physical and mechanical properties such as dry-wet flexural strength, compressive strength, and shear strength and wet electrical properties of the reinforced plastics, and improve the wettability and dispersibility of the filler in the polymer.

The coupling agent KH-560 is γ-glycidoxypropyltrimethoxysilane, corresponding to the grade A-187 (GE), and is commonly used in multi-sulfide and polyurethane caulks and sealants, epoxy resin adhesives, filled or reinforced thermosetting resins, glass fibers or glass reinforced thermoplastic resins.

The coupling agent KH-570 is methacryloxysilane, corresponding to the grade A-174 (GE), and the appearance is a colorless or yellowish transparent liquid, which is soluble in acetone, benzene, ether, carbon tetrachloride, and reacts with water. This coupling agent has a boiling point of 255° C., a density of 1.04 g/ml, a refractive index of 1.429, and a flash point of 88° C., which is mainly used for unsaturated polyester resins, and also for polybutene, polyethylene and ethylene propylene diene monomer.

The coupling agent KH-580 is γ-mercaptopropyltriethoxysilane, corresponding to the grade A-1891 (USA), a colorless transparent liquid with a special odor, and is easily soluble in various solvents such as ethanol, acetone, benzene, and toluene. This coupling agent is insoluble in water, but is prone to hydrolysis when contacted with water or moisture, and has a boiling point of 82.5° C., a specific gravity of 1.000 (20° C.), a flash point of 87° C., and a molecular weight of 238.

The coupling agent KH-590 is γ-mercaptopropyltrimethoxysilane, corresponding to the grade A-189 (USA), has a molecular weight of 196.3399, a density of 1.057 g/ml, a boiling point of 213-215° C., a refractive index of 1.441-1.443 and a flash point of 88° C., and is often used as a glass fiber treating agent and a crosslinking agent.

The coupling agent KH-792 is N-β-(aminoethyl)-γ-aminopropyltrimethoxysilane with a molecular formula $NH_2(CH_2)_2NH(CH_2)_3Si(OCH_3)_3$, has a molecular weight of 222, a density of 1.010-1.030 g/ml, a boiling point of 259° C., a refractive index of 1.4425-1.4460, and a flash point of 138° C., and is soluble in organic solvents.

The coupling agent KH-902 is γ-aminopropylmethyldiethoxysilane with a molecular formula $NH_2(CH_2)_3SiCH_3(OC_2H_5)_2$, has a molecular weight of 191.34, a density of 0.9160±0.0050 g/ml, a boiling point of 85-88° C./1.07 KPa, and a refractive index of 1.4270±0.0050, and is suitable for most organic and inorganic materials.

According to one aspect of the invention, the graphene slurry is a mixture of graphene-anhydrous ethanol.

Preferably, the graphene slurry has a graphene concentration of 1 wt % to 8 wt %, preferably 5 wt %.

According to one aspect of the invention, the graphene is a graphene powder having a single-layer or a multi-layer structure; preferably, the single-layer or multi-layer structure graphene has a sheet diameter of 0.5-5 μm and a thickness of 0.5-30 nm; more preferably, the single-layer or multi-layer structure graphene has a specific surface area of 200-1000 $m^2/g$.

According to one aspect of the invention, in the method for preparing the graphene slurry premix, the graphene-anhydrous ethanol mixture is ground to a graphene particle size of D99<7 μm, preferably, for 3-5 h by a sand mill, more preferably, the sand mill uses zirconia beads as grinding medium when grinding, preferably, the zirconia beads have a particle diameter of 0.6-0.8 mm; and the sand mill has a rotation speed of 1500-2800 rpm.

According to one aspect of the invention, in the method for preparing the graphene slurry premix, the filtration employs suction filtration to remove most of the anhydrous ethanol.

According to one aspect of the invention, in the method for preparing the graphene slurry premix, the first UHMWPE is added to the second white oil contained graphene filter residue under high speed stirring; preferably, the high-speed stirring has a stirring speed of 1800-2000 rpm; and a stirring time of 5-20 min, preferably 10 min.

According to one aspect of the invention, in the method for preparing the graphene slurry premix, the first temperature is 80-90° C.

According to one aspect of the invention, in the method for preparing the graphene slurry premix, the second temperature is 135-170° C., preferably 150° C.

According to one aspect of the invention, in the method for preparing the graphene slurry premix, after heating to the second temperature, the second temperature is maintained for 2.5-4.5 h, preferably 3 h.

After reiterative derivations and tests were conducted in the present invention, during the preparation of the graphene slurry premix, two kinds of temperature treatments used achieve good effects, so that the graphene slurry is not only homogeneously dispersed and strong in homogeneousness and stability, but also has strong fusion with the glass fiber premix and white oil. Wherein the first temperature (80-90° C.) is intended to remove most of the anhydrous ethanol remaining in the graphene residue, after that a further process is conducted. The purpose of the second temperature incubation is to allow the UHMWPE to absorb sufficient energy without chemical reaction for fully swelling and completely dissolving in the white oil. The dissolution of the crystalline polymer must first absorb enough energy to cause the molecular chain movement to destroy the original lattice and break the regular arrangement of the molecular chain. It has been found that this effect can be achieved by removing most of the ethanol and holding it at 135-170° C. for 2.5-4.5 h.

According to one aspect of the invention, the first UHMWPE has a viscosity average molecular weight of $(2\text{-}6)\times10^6$ g/mol, preferably $(4\text{-}5)\times10^6$ g/mol.

Further preferably, the graphene slurry premix has a graphene concentration of 1-8 wt %, preferably 5 wt %, and a first UHMWPE concentration of 0.1-0.3 wt %, preferably 0.2 wt %.

According to one aspect of the invention, the second UHMWPE has a viscosity average molecular weight of $(2\text{-}6)\times10^6$ g/mol, preferably $(4\text{-}5)\times10^6$ g/mol.

According to one aspect of the invention, the antioxidant is one or a combination of two or more of antioxidant 1010, antioxidant 1076, antioxidant CA, antioxidant 164, antioxidant DNP, antioxidant DLTP, or antioxidant TNP.

The antioxidant 1010 is an abbreviation of tetrakis[β-(3,5-di-tert-butyl-4-hydroxyphenyl)propanoic acid] pentaerythritol ester, a white fluid powder with a melting point of 120-125° C. and low toxicity, which is a good antioxidant. This antioxidant is widely used in polypropylene resin as a kind of adjuvant with high thermal stability and very suitable for use under high temperature conditions, and can prolong the service life of the product. In addition, it can also be used for most other resins.

The antioxidant 1076 is an abbreviation of octadecyl β-(3,5-di-tert-butyl-4-hydroxyphenyl)propionate, a white or yellowish crystalline powder with a melting point of 50-55° C., which is non-toxic, insoluble in water, but soluble in solvents such as benzene, ethane and esters. This antioxidant can be used as an antioxidant for resins such as polyethylene, polypropylene, polystyrene, polyvinyl chloride, polyamide, ABS and acrylic. It has the characteristics of good anti-oxidation, low volatility and resistance to washing.

The antioxidant CA is an abbreviation of 1,1,3-tris(2-methyl-4-hydroxy-5-tert-butylphenyl)butane, a white crystalline powder with a melting point 180~188° C. and low toxicity, which is soluble in ethanol, toluene and ethyl acetate. This antioxidant is suitable for anti-oxidation adjuvants in polypropylene, polyethylene, polyvinyl chloride, ABS and polyamide resins, and can be used for wires and cables in contact with copper.

The antioxidant 164 is a white or light yellow crystalline powder or sheet having a melting point of 70° C. and a boiling point of about 260° C. and is non-toxic, which is used in a variety of resins and is widely used. This antioxidant is more suitable for use in food packaging molding materials (polypropylene, polyethylene, polyvinyl chloride, ABS, polyester, and polystyrene) resins.

The antioxidant DNP is an abbreviation of N,N'-bis(β-naphthyl)p-phenylenediamine, a light gray powder with a melting point of about 230° C., which is readily soluble in aniline and nitrobenzene, but insoluble in water, and is suitable for polyethylene and polypropylene. Anti-impact polystyrene and ABS resin, in addition to having anti-oxidation performance, have better thermal stability and inhibit the influence of copper and manganese metal.

The antioxidant DLTP is an abbreviation of dilauryl thiodipropionate, a white crystalline powder with a melting point of about 40° C. and low toxicity, which is insoluble in water, but soluble in benzene, carbon tetrachloride. This antioxidant is used as an auxiliary antioxidant for polyethylene, polypropylene, ABS and polyvinyl chloride resins, so that it can alter the heat resistance and oxidation resistance of the product.

The antioxidant TNP is an abbreviation of tris(nonylphenyl)phosphite, a light yellow viscous liquid with a freezing point below −5° C. and a boiling point greater than 105° C., which is odorless, non-toxic, insoluble in water, but soluble in ethanol, benzene and carbon tetrachloride. This antioxidant is suitable for resins such as polyvinyl chloride, polyethylene, polypropylene, anti-impact polystyrene, ABS and polyester.

According to one aspect of the invention, in the method for preparing the spinning mixture, the glass fiber premix and the graphene slurry premix are first mixed at a high speed in an emulsifier, and then added to a swelling kettle containing the second UHMWPE and the third white oil, and then the antioxidant is further added to prepare the spinning mixture.

According to one aspect of the invention, in the method for preparing the spinning mixture, the second UHMWPE: the third white oil has a mass ratio of 6:94.

According to one aspect of the invention, in the method for preparing the spinning mixture, the glass fiber is 0.2-10% by weight, preferably 1-6% by weight based on the mass of the composite ultra-high molecular weight polyethylene fiber.

According to one aspect of the invention, in the method for preparing the spinning mixture, the antioxidant is added in an amount of 0.01-1% by weight, preferably 0.1-0.5% by weight based on the mass of the composite ultra-high molecular weight polyethylene fiber.

According to one aspect of the invention, the swelling is carried out by heating to 100° C. to 140° C. in a swelling kettle and holding for 1 h to 3 h; preferably to 110° C. for 2 h.

The purpose of swelling is to maximize the penetration and diffusion of the solvent into the interior of the polymer. The penetration of the solvent can weaken the strong interaction between the macromolecular chains. The more solvation effect, the easier it is to enter the dissolution stage. Moreover, because the crystalline polymer is in a thermodynamically stable phase, the molecular chains are closely arranged, the interaction between the molecular chains is large, and the solvent molecules can hardly enter the crystal region. Therefore, in order to dissolve the crystalline polymer, it is necessary to absorb enough energy to make the molecular chain move enough to destroy the crystal lattice and break the regular arrangement of the molecular chain. Therefore, UHMWPE needs to swell at a temperature higher than 100° C., and dissolves when the temperature is higher. At 100-140° C., white oil is more likely to enter UHMWPE, especially at 110° C.

According to one aspect of the invention, the extrusion is carried out using a twin-screw extruder. The extrusion temperature is raised stepwise from 110° C. to 243° C. Preferably, the twin-screw extruder has an aspect ratio of 68, and is composed of a feed section, a heating section, a dissolution section, and a homomixing section.

The swollen UHMWPE molecular chain still maintains a certain number of instantaneous entanglement points, and the stepwise temperature extrusion causes the macromolecule to disperse into the solution as a whole coil, and the entanglement points are removed, thereby enhancing the solvation effect of the solvent on UHMWPE.

According to one aspect of the invention, the cooling is cooled by water condensation.

According to one aspect of the present invention, the method for preparing the graphene composite ultra-high molecular weight polyethylene fiber by using the gel-spun comprises: forming the fiber by preliminary stretching, extraction, drying, and ultra-hot stretching of the gel-spun.

Preferably, the preliminary stretching has a stretch ratio of 4.5 times; the ultra-hot stretching uses a 3-stage ultra-hot stretching, wherein the stretching temperature is 140-146° C.; the extraction adopts a continuous multi-stage closed ultrasonic extraction machine and a hydrocarbon extraction high-stretching device, and the extraction temperature is 40° C.; preferably, the extraction adopts a multi-stage multi-tank, quantitative rehydration and liquid discharge process to control the oil content after the extraction of the gel-spun, and an ultrasonic generator is added for full extraction, and a water circulation mold temperature controller is provided to precisely control the temperature of the extraction, the temperature difference ≤±1° C., extraction rate ≥99%.

The present invention also provides a composite ultra-high molecular weight polyethylene fiber, wherein the fiber comprises glass fiber and graphene, the glass fiber has a content of 0.2-10% by weight of the composite ultra-high molecular weight polyethylene fiber, and the graphene has a content of 0.01-3% by weight of the composite ultra-high molecular weight polyethylene fiber.

According to one aspect of the invention, the glass fiber accounts for 1-6 wt % of the composite ultra-high molecular weight polyethylene fiber, and the graphene accounts for 0.05 wt % of the composite ultra-high molecular weight polyethylene fiber.

According to one aspect of the invention, the glass fiber has a diameter of 3-10 μm, preferably 5-7 μm; and/or the glass fiber has an average length of 30-100 μm, preferably 50-70 μm; and/or the glass fiber has a length in the range of 10-600 μm, preferably 50-400 μm.

According to one aspect of the invention, the graphene is a graphene powder having a single-layer or a multi-layer structure; further preferably, the single-layer or multi-layer structure graphene has a sheet diameter of 0.5-5 μm and a thickness of 0.5-30 nm; more preferably, the single-layer or multi-layered structure graphene has a specific surface area of 200-1000 $m^2/g$.

According to one aspect of the invention, the UHMWPE has a viscosity average molecular weight of $(2\text{-}6)\times10^6$ g/mol, preferably $(4\text{-}5)\times10^6$ g/mol.

According to one aspect of the invention, the composite ultra-high molecular weight polyethylene fiber is prepared according to the above method.

BRIEF DESCRIPTION OF DRAWINGS

The drawings are intended to provide a further understanding of the invention, and are intended to be a part of the description of the invention. In the drawings.

DETAILED DESCRIPTION

Figure 1:
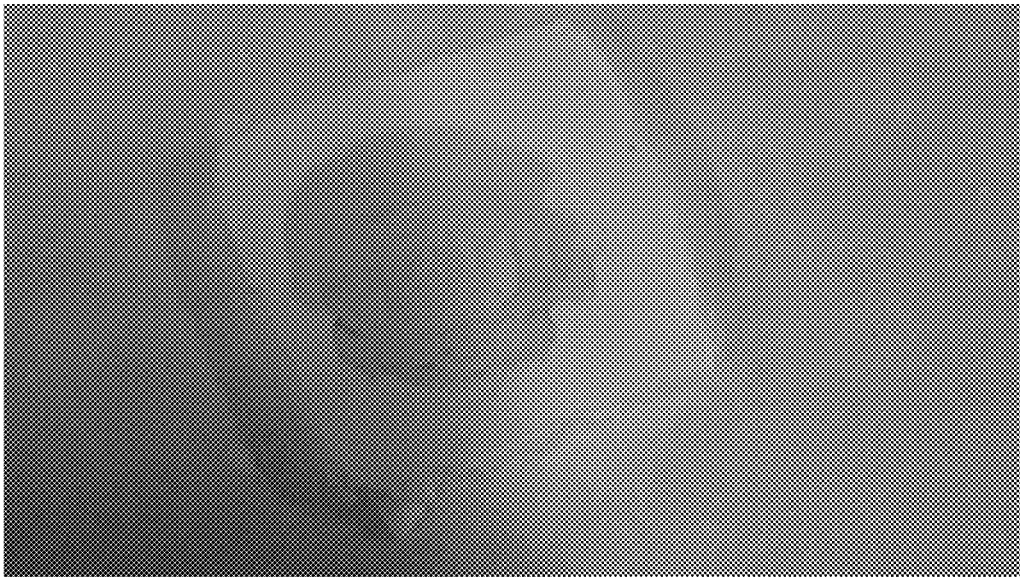
FIG. 1 is an infiltration of water droplets after 5 seconds on the surface of the glass fiber which is not treated with a coupling agent.
Figure 2:
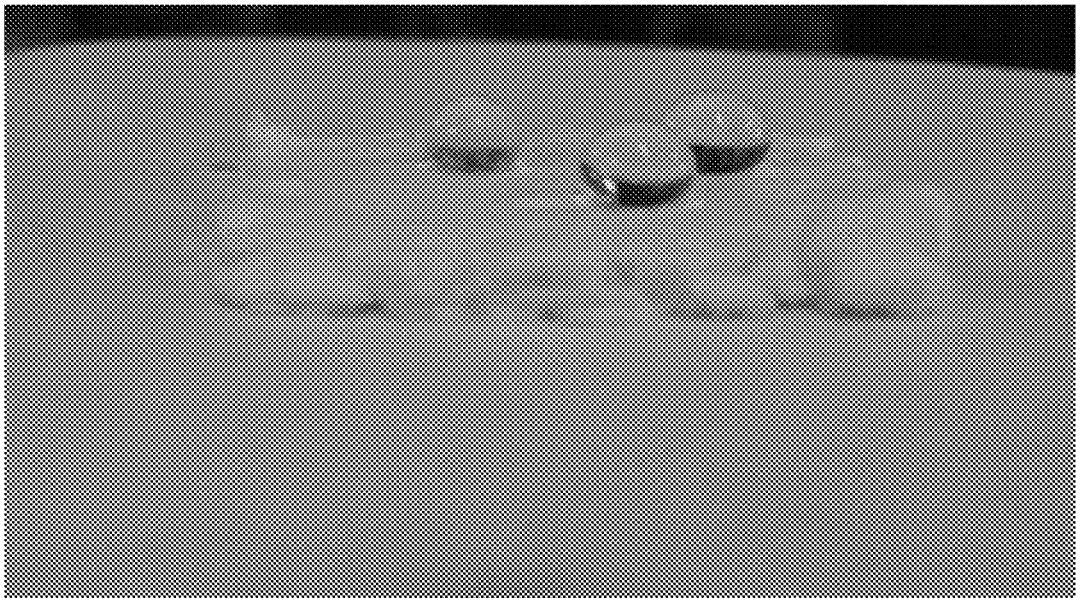
FIG. 2 is an infiltration of water droplets after 5 seconds on the surface of the glass fiber which is treated with a coupling agent.
Figure 3:
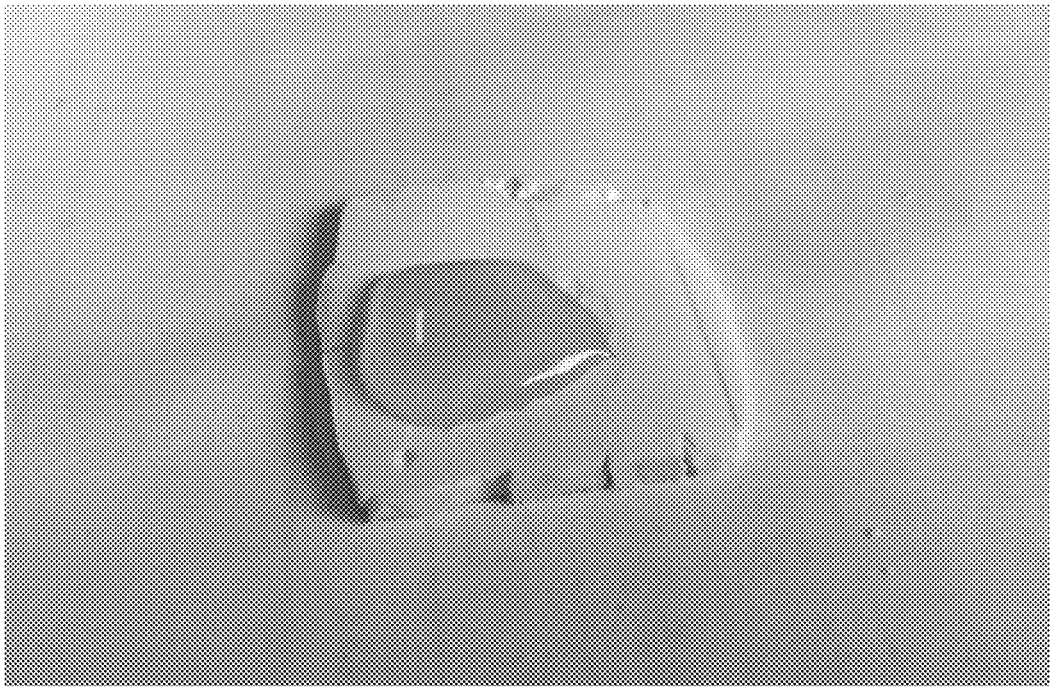
FIG. 3 is an infiltration of oil droplets after 5 seconds on the surface of the glass fiber which is not treated with a coupling agent.
Figure 4:
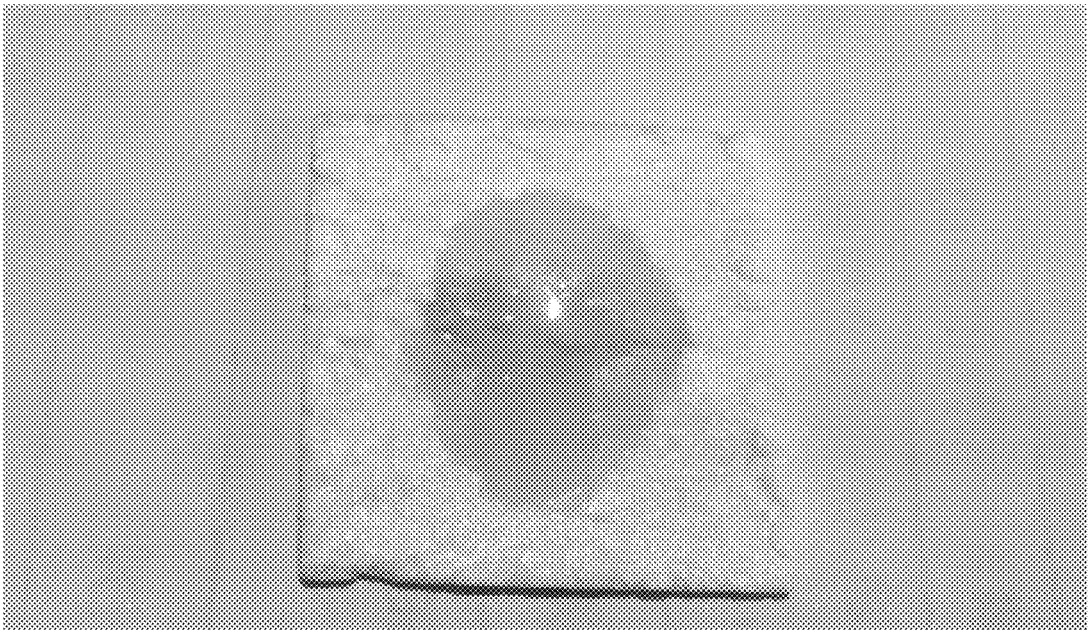
FIG. 4 is an infiltration of oil droplets after 5 seconds on the surface of the glass fiber which is treated with a coupling agent.

In the following, only certain exemplary embodiments are briefly described. The described embodiments may be modified in various different ways, such as additions, deletions, modifications, and the like, without departing from the spirit and scope of the invention. Accordingly, the drawings and description are considered to be exemplary rather than limited in nature.

In the disclosure of the present invention, the terms "first white oil", "second white oil", and "third white oil" are all white oils, and "first", "second" and "third" are not limitations on white oil itself, but only to distinguish the different applications of the white oils in the preparation method of the present invention.

In a specific embodiment of the present invention, a method for preparing a composite ultra-high molecular weight polyethylene fiber is provided, comprising: mixing glass fiber, graphene slurry, UHMWPE powder and white oil, swelling to a molten state, cooling into a gel-spun, and finally forming a fiber from the gel-spun.

According to a preferred embodiment of the invention, the glass fiber accounts for 0.2-10 wt %, such as 0.2 wt %, 0.3 wt %, 0.5 wt %, 0.7 wt %, 0.9 wt %, 1 wt %, 2 wt %, 3 wt %, 4 wt %, 5 wt %, 6 wt %, 7 wt %, 8 wt %, 9 wt %, 10 wt %, of the composite ultra-high molecular weight polyethylene fiber. Preferably, the fiber comprises glass fiber, and the glass fiber has a content of 1-6 wt %, for example, 1 wt %, 1.2 wt %, 1.5 wt %, 1.8 wt %, 2 wt %, 2.3 wt %, 2.5 wt %, 3 wt %, 3.5 wt %, 3.7 wt %, 4 wt %, 4.5 wt %, 4.8 wt %, 5 wt %, 5.1 wt %, 5.5 wt %, 5.7 wt %, 6 wt %. The glass fiber referred to herein is interpreted in a broad sense, including narrowly defined glass fiber, as well as glass fiber treated with some modification methods. The graphene accounts for 0.01-3 wt %, such as 0.01 wt %, 0.05 wt %, 0.1 wt %, 0.3 wt %, 0.5 wt %, 0.6 wt %, 0.7 wt %. 0.8 wt %, 0.9 wt %, 1 wt %, 1.2 wt %, 1.4 wt %, 1.6 wt %, 1.8 wt %, 2 wt %, 2.2 wt %, 2.4 wt %, 2.6 wt %, 2.8 wt %, 3 wt %; preferably 0.05 wt %, of the composite ultra-high molecular weight polyethylene fiber.

In one embodiment of the present invention, a method 100 for preparing a composite ultra-high molecular weight polyethylene fiber is provided, comprising:

101: dispersing glass fiber in a first white oil to obtain a glass fiber premix;

102: Pretreating graphene slurry to obtain pretreated graphene;

103: Adding the pretreated grapheme into a second white oil, then adding a first UHMWPE to the second white oil containing the pretreated graphene, heating the above solution to a first temperature, heating the solution to a second temperature after the solution was not bubbled, and maintaining the second temperature to obtain a graphene slurry premix;

104: Mixing the glass fiber premix, the graphene slurry premix, a second UHMWPE, an antioxidant, and a third white oil to obtain a spinning mixture;

105: Swelling and mixing the spinning mixture to form a molten state; extruding the spinning mixture which was in the molten state; then cooling to form a gel-spun; and

106: Obtaining the composite ultra-high molecular weight polyethylene fiber from the gel-spun.

Each process will be described in detail below.

In 101:

The glass fiber premix contains 5-30 wt %, such as 5 wt %, 7 wt %, 8 wt %, 10 wt %, 11 wt %, 13 wt %, 15 wt %, 17 wt %, 18 wt %, 19 wt %, 20 wt %, 21 wt %, 22 wt %, 23 wt %, 25 wt %, 26 wt %, 27 wt %, 29 wt %, 30 wt %, of glass fiber. As a preferred embodiment, the glass fiber premix contains 10-25 wt %, such as 10 wt %, 11 wt %, 12 wt %, 13.5 wt %, 14 wt %, 15 wt %, 16 wt %, 16.5 wt %, 17 wt %, 18 wt %, 19 wt %, 20 wt %, of glass fiber. As a preferred embodiment, the glass fiber premix contains 25 wt % of glass fiber.

The glass fiber premix is specifically prepared by first pouring the glass fiber into the first white oil and premixing, and then stirring at a high speed with an emulsifier to form a homogeneous slurry. The purpose of this is: The mixture of glass fiber and white oil is forced by mechanical action to pass through a narrow gap at a high speed. Under the action of hydromechanical effects, due to the great velocity gradient in the narrow gap between the rotor and the stator created by the high tangential speed generated by the high-speed rotation of the rotor creates, and the strong kinetic energy created by the high-frequency mechanical effect, the material is subjected to a synthetic action of strong hydraulic shearing, centrifugal extrusion, liquid layer friction, impact tearing and turbulence and the like in the gap between the stator and the rotor, so that the incompatible solid phase and liquid phase are homogeneously and finely dispersed and homogenized under the function of the additive, and then the dispersed phase particles or droplets are broken to achieve the purpose of homogeneous emulsification after high frequency circulation. The high speed stirring has a stirring speed of 3000-10000 rpm, for example 3000 rpm, 3500 rpm, 3800 rpm, 4000 rpm, 4300 rpm, 4500 rpm, 5000 rpm, 5500 rpm, 6000 rpm, 6500 rpm, 6700 rpm, 7000 rpm, 7200 rpm, 7600 rpm, 8000 rpm, 8500 rpm, 9000 rpm, 10000 rpm; preferably 3500 rpm. The high speed stirring may have a stirring time of 5-60 min, for example: 5 min, 8 min, 10 min, 11 min, 12 min, 15 min, 19 min, 20 min, 25 min, 30 min, 33 min, 35 min, 40 min, 45 min, 47 min, 50 min, 55 min, 60 min. The stirring time is preferably 10 min-30 min, for example: 10 min, 11 min, 12 min, 13 min, 15 min, 16 min, 18 min, 20 min, 22 min, 23 min, 25 min, 27 min, 28 min, 30 min; optimally 15 min. The glass fiber has a diameter of 3-10 μm, for example: 3 μm, 4 μm, 5 μm, 6 μm, 7 μm, 8 μm, 9 μm, 10 μm; preferably 5-7 μm, for example: 5 μm, 5.5 μm, 5.7 μm, 6 μm, 6.2 μm, 6.5 μm, 6.8 μm, 7 μm. The glass fiber has an average length of 30-100 μm, for example: 30 μm, 32 μm, 35 μm, 40 μm, 45 μm, 48 μm, 50 μm, 55 μm, 59 μm, 60 μm, 65 μm, 70 μm, 75 μm, 80 μm, 82 μm, 85 μm, 88 μm, 90 μm, 95 μm, 100 μm; preferably 50-70 μm, for example: 50 μm, 52 μm, 53 μm, 55 μm, 57 μm, 59 μm, 60 μm, 61 μm, 63 μm, 65 μm, 66 μm, 68 μm, 70 μm. The glass fiber has a length in the range of 10 to 600 μm, for example, 10-500 μm, 20-550 μm, 50-200 μm, 30-60 μm, 35-150 μm, 40-400 μm, 60-300 μm, 55-350 μm, 80-150 μm; preferably 50-400 μm, for example: 50-300 μm, 60-200 μm, 60-400 μm, 50-100 μm, 70-150 μm.

In 102:

The pretreatment of the graphene slurry is as follows: the graphene slurry is ground to a graphene particle size of D99<7 μm, and filtered to obtain a graphene filter residue, thereby obtaining the pretreated graphene.

As a preferred embodiment, the graphene slurry is a mixture of graphene-anhydrous ethanol, wherein the concentration of graphene is 1-8 wt %, for example: 1 wt %, 2 wt %, 3 wt %, 4 wt %, 5 wt %, 6 wt %, 7 wt %, 8 wt %; more preferably 5 wt %.

The graphene is a graphene powder having a single-layer or multi-layer structure; preferably, the graphene having a single-layer or multi-layer structure has a sheet diameter of 0.5 to 5 μm, for example, 0.5 μm, 1 μm, 1.5. μm, 2 μm, 2.5 μm, 3 μm, 3.5 μm, 4 μm, 4.5 μm, 5 μm; a thickness of 0.5 to 30 nm, for example: 0.5 nm, 5 nm, 10 nm, 15 nm, 20 nm, 25 nm, 30 nm; more preferably, the single-layer or multi-layer structure graphene has a specific surface area of 200-1000 $m^2/g$, for example: 200 $m^2/g$, 300 $m^2/g$, 400 $m^2/g$, 500 $m^2/g$, 600 $m^2/g$, 700 $m^2/g$, 800 $m^2/g$, 900 $m^2/g$, 1000 $m^2/g$.

As a preferred embodiment, the grinding is performed by a sand mill with a grinding time of 3-4 h. More preferably, the grinding medium may be zirconia beads when the grinding is conducted. Preferably, the zirconia beads may have a particle diameter of 0.6-0.8 mm; the sand mill may have a rotation speed of 1500-2800 rpm, for example: 1500 rpm, 1600 rpm, 1700 rpm, 1800 rpm, 1900 rpm. 2000 rpm, 2100 rpm, 2200 rpm, 2300 rpm, 2400 rpm, 2500 rpm, 2600 rpm, 2700 rpm, 2800 rpm; the filtration was filtered by suction filtration to remove most of the anhydrous ethanol.

In 103:

The preparation method of the graphene slurry premix is: Adding the pretreated graphene to the second white oil, and adding the first UHMWPE to the second white oil containing the pretreated graphene under high speed stirring, heating the above solution to the first temperature; after the solution was not bubbled, heating the solution to the second temperature and maintaining the second temperature.

The high speed stirring has a stirring speed of 1800-2000 rpm; the high speed stirring has a stirring time of 5-20 min, for example: 5 min, 8 min, 11 min, 14 min, 17 min, 20 min; preferably 10 min. The first temperature is 80-90° C., for example: 80° C., 81° C., 82° C., 83° C., 84° C., 85° C., 86° C., 87° C., 88° C., 89° C., 90° C. The second temperature is 135-170° C., for example: 135° C., 140° C., 145° C., 150° C., 155° C., 160° C., 165° C., 170° C.; preferably 150° C. After the heating to the second temperature, the temperature is maintained for 2.5-4.5 h, for example: 2.5 h, 2.7 h, 2.9 h, 3 h, 3.1 h, 3.3 h, 3.5 h, 3.7 h, 3.9 h, 4.1 h, 4.3 h, 4.5 h; preferably 3 h.

According to a preferred embodiment of the present invention, the first UHMWPE may have a viscosity average molecular weight of $(2\text{-}6)\times10^6$ g/mol, for example: $2\times10^6$ g/mol, $3\times10^6$ g/mol, $4\times10^6$ g/mol, $5\times10^6$ g/mol, $6\times10^6$ g/mol; preferably $(4\text{-}5)\times10^6$ g/mol.

According to a preferred embodiment of the present invention, the graphene slurry premix has a graphene concentration of 1-8 wt %, for example: 1 wt %, 2 wt %, 3 wt %, 4 wt %, 5 wt %, 6 wt %, 7 wt %, 8 wt %, preferably 5 wt %; and the first UHMWPE has a mass fraction of 0.1-0.3 wt %, preferably 0.2 wt %.

In 104:

In the method for preparing the spinning mixture, the glass fiber premix and the graphene slurry premix are first mixed at a high speed in an emulsifier, and then added to a swelling kettle containing the second UHMWPE and the third white oil, and then the antioxidant is added to prepare the spinning mixture.

In the preparation of the spinning mixture, the second UHMWPE:the third white oil has a mass ratio of 6:94.

The amount of the glass fiber premix is such that the glass fiber is 0.2-10 wt %, such as 0.2 wt %, 0.3 wt %, 0.5 wt %, 0.7 wt %, 0.9 wt %, 1 wt %, 2 wt %, 3 wt %, 4 wt %, 5 wt %, 6 wt %, 7 wt %, 8 wt %, 9 wt %, 10 wt %; preferably 1-6 wt %, such as 1 wt %, 1.2 wt %, 1.5 wt %, 1.8 wt %, 2 wt %, 2.3 wt %, 2.5 wt %, 3 wt %, 3.5 wt %, 3.7 wt %, 4 wt %, 4.5 wt %, 4.8 wt %, 5 wt %, 5.1 wt %, 5.5 wt %, 5.7 wt %, 6 wt %, of the composite ultra-high molecular weight polyethylene fiber. The glass fiber referred to herein is interpreted in a broad sense, including narrowly defined glass fiber, as well as glass fiber treated with some modification methods.

The amount of the graphene slurry premix is such that the graphene accounts for 0.01-3 wt %, such as 0.01 wt %, 0.05 wt %, 0.1 wt %, 0.3 wt %, 0.5 wt %, 0.6 wt %, 0.7 wt %, 0.8 wt %, 0.9 wt %, 1 wt %, 1.2 wt %, 1.4 wt %, 1.6 wt %, 1.8 wt %, 2 wt %, 2.2 wt %, 2.4 wt %, 2.6 wt %, 2.8 wt %, 3 wt %; preferably 0.05 wt %, of the composite ultra-high molecular weight polyethylene fiber.

The antioxidant is used in an amount such that the antioxidant accounts for 0.01-1 wt %, such as 0.01 wt %, 0.02 wt %, 0.05 wt %, 0.07 wt %, 0.09 wt %, 0.1 wt %, 0.11 wt %, 0.13 wt %, 0.15 wt %, 0.18 wt %, 0.19 wt %, 0.2 wt %, 0.25 wt %, 0.3 wt %, 0.4 wt %, 0.5 wt %, 0.55 wt %, 0.6 wt %, 0.65 wt %, 0.7 wt %, 0.8 wt %, 0.88 wt %, 0.9 wt %, 1 wt %; preferably 0.1-0.5 wt %, such as 0.1 wt %, 0.12 wt %, 0.13 wt %, 0.15 wt %, 0.17 wt %, 0.2 wt %, 0.23 wt %, 0.25 wt %, 0.26 wt %, 0.28 wt %, 0.3 wt %, 0.33 wt %, 0.35 wt %, 0.4 wt %, 0.42 wt %, 0.45 wt %, 0.48 wt %, 0.5 wt %, of the composite ultra-high molecular weight polyethylene fiber.

The second UHMWPE may have a viscosity average molecular weight of $(2\text{-}6)\times10^6$ g/mol, for example: $2\times10^6$ g/mol, $3\times10^6$ g/mol, $4\times10^6$ g/mol, $5\times10^6$ g/mol, $6\times10^6$ g/mol; preferably $(4\text{-}5)\times10^6$ g/mol.

The antioxidant may be one or a combination of two or more of antioxidant 1010, antioxidant 1076, antioxidant CA, antioxidant 164, antioxidant DNP, antioxidant DLTP, or antioxidant TNP.

In 105:

The spinning mixture is swollen and mixed to form a molten state, and the spinning mixture in the molten state is extruded and cooled to form a gel-spun. Wherein the swelling is carried out by heating to 100-140° C. in a swelling kettle, for example by heating to 100° C., 105° C., 110° C., 115° C., 120° C., 125° C., 130° C., 135° C., 140° C. Hold at this temperature for 1-3 h. As a preferred embodiment, the swelling is carried out by heating to 110° C. in a swelling kettle for 2 h. The purpose of swelling is to maximize the penetration and diffusion of the solvent into the interior of the polymer. The penetration of the solvent can weaken the strong interaction between the macromolecular chains. The more solvation effect, the easier it is to enter the dissolution stage. Moreover, because the crystalline polymer is in a thermodynamically stable phase, the molecular chains are closely arranged, the interaction between the molecular chains is large, and the solvent molecules can hardly enter the crystal region. Therefore, in order to dissolve the crystalline polymer, it is necessary to absorb enough energy to make the molecular chain move enough to destroy the crystal lattice and break the regular arrangement of the molecular chain. Therefore, UHMWPE needs to swell at a temperature higher than 100° C., and dissolves when the temperature is higher. At 100-140° C., white oil is more likely to enter UHMWPE, especially at 110° C.

The extrusion is carried out using a twin-screw extruder. The extrusion temperature is raised stepwise from 110° C. to 243° C. Preferably, the twin-screw extruder has an aspect ratio of 68, and is composed of a feed section, a heating section, a dissolution section, and a homomixing section. The swollen UHMWPE molecular chain still maintains a certain number of instantaneous entanglement points, and the stepwise temperature extrusion causes the macromolecule to disperse into the solution as a whole coil, and the entanglement points are removed, thereby enhancing the solvation effect of the solvent on UHMWPE.

The cooling is cooled by water condensation.

In 106:

The method for preparing the composite ultra-high molecular weight polyethylene fiber by using the gel-spun is as follows: the composite fiber is obtained by preliminary stretching, extraction, drying, and ultra-hot stretching of the gel-spun. Wherein the preliminary stretching has a stretch ratio of 4.5 times, and the ultra-hot stretching uses a 3-stage ultra-hot stretching, wherein the stretching temperature is 140-146° C., for example, 140° C., 141° C., 142° C., 143° C., 145° C., 146° C.

The extraction adopts a continuous multi-stage closed ultrasonic extraction machine and a hydrocarbon extraction high-stretching device, and the extraction temperature is 40° C.; as a preferred embodiment, the extraction adopts a multi-stage multi-tank, quantitative rehydration and liquid discharge process to control the oil content after the extraction of the gel-spun, and an ultrasonic generator is added for full extraction, and a water circulation mold temperature controller is provided to precisely control the temperature of the extraction, the temperature difference ≤±1° C., extraction rate ≥99%.

In another embodiment of the present invention, a method 200 for preparing a composite ultra-high molecular weight polyethylene fiber is provided, comprising:

201: pretreating glass fiber to obtain pretreated glass fiber;

202: dispersing the pretreated glass fiber in a first white oil to obtain a glass fiber premix;

203: pretreating the graphene slurry to obtain pretreated graphene;

204: adding pretreated graphene to a second white oil, then adding a first UHMWPE to a second white oil containing the pretreated graphene, heating the solution to a first temperature, after the solution was not bubbled, heating the solution to a second temperature, and maintaining the second temperature to obtain a graphene slurry premix;

205: mixing the glass fiber premix, the graphene slurry premix, a second UHMWPE, an antioxidant, and a third white oil to obtain a spinning mixture;

206: Swelling and mixing the spinning mixture to form a molten state; extruding the spinning mixture which was in the molten state; then cooling to form a gel-spun; and

207: Obtaining the composite ultra-high molecular weight polyethylene fiber from the gel-spun.

The method 200 disclosed in this embodiment is Substantially the same as the method 100 for preparing the composite ultra-high molecular weight polyethylene fiber, and the difference is the addition of a glass fiber pretreatment process, in which the glass fiber is pretreated with a coupling agent before the preparation of the glass fiber premix. The expansion process 201 will be described below.

In 201, the specific treatment method is as follows: the coupling agent is dissolved in anhydrous ethanol, and then the glass fiber is added to mix homogeneously, immersed, dried, ground, and filtered by 100 mesh. The coupling agent is added in an amount of 0.01-10%, such as 0.01%, 0.02%, 0.05%, 0.07%, 0.1%, 0.2%, 0.3%, 0.5%, 0.6%, 0.9%, 1%, 2%, 3%, 4%, 5%, 7%, 8%, 10%, by weight of the total mass of the glass fiber. As a preferred embodiment of the present embodiment, the coupling agent is added in an amount of 0.2%-5%, such as 0.2%, 0.3%, 0.4%, 0.5%, 0.6%, 0.7%, 0.8%, 0.9%, 1%, 1.5%, 2%, 3%, 4%, 5%, by weight of the total mass of the glass fiber. The immersion time of the glass fiber in the coupling agent ethanol solution is 10 min-5 h, for example: 10 min, 20 min, 30 min, 40 min, 50 min, 1 h, 1.5 h, 2 h, 2.5 h, 3 h, 3.5 h, 4 h, 4.5 h, 5 h. As a preferred embodiment of the present embodiment, the immersion time of the glass fiber in the coupling agent ethanol solution is 30 min-2 h, for example: 30 min, 40 min, 45 min, 50 min, 60 min, 70 min, 80 min, 90 min, 100 min, 120 min. The drying temperature is 50° C.-180° C., for example: 50° C., 60° C., 70° C., 80° C., 90° C., 100° C., 110° C., 120° C., 130° C., 140° C., 150° C., 160° C., 170° C., 180° C. As a preferred embodiment of the present embodiment, the drying temperature is 80° C.-130° C., for example: 80° C., 85° C., 90° C., 95° C., 100° C., 105° C., 110° C., 115° C., 120° C., 125° C., 130° C. The drying time is 1 h-6 h, for example: 1 h, 2 h, 2.5 h, 3 h, 3.5 h, 4 h, 5 h, 6 h. As a preferred embodiment of the present embodiment, the drying time is 2 h-3 h.

According to an embodiment of the present invention, the coupling agent may be one or a mixture of two or more of silane coupling agents. One or a mixture of two or more of A-150, A-151, A-171, KH-550, KH-560, KH-570, KH-580, KH-590, KH-902 or KH-792 in the silane coupling agents is used. The A-150, A-151, A-171, KH-550, KH-560, KH-570, KH-580, KH-590, KH-902 or KH-792 are the grades of the silane coupling agents, and the performance of the different grades coupling agents is different. These grades are internationally recognized grades. A silane coupling agent is a kind of low molecular organosilicon compound with special structure, and its general formula is $RSiX_3$, wherein R represents a reactive functional group having affinity or reactivity with a polymer molecule, such as oxyl, vinyl, epoxy, amide, aminopropyl group; X represents an alkoxy group capable of being hydrolyzed, such as halogen, alkoxy, acyloxy. During the coupling, the X group is first formed into a silanol, and then reacted with a hydroxyl group on the surface of the inorganic powder particles to form a hydrogen bond and further condensed into a —SiO-M covalent bond (M represents the surface of the inorganic powder particles). At the same time, the silanol of each molecule of the silane is associated with each other to form a network structure film covering the surface of the powder particles to organicize the surface of the inorganic powder. The coupling agent A-150 is vinyl trichlorosilane, a colorless liquid, soluble in an organic solvent, and easily hydrolyzed and alcoholyzed. The coupling agent A-150 has a molecular formula of $CH_2{=}CHSiCl_3$, a molecular weight of 161.5, a boiling point of 90.6° C., and a density of 1.265 g/cm$^3$, which is suitable for glass fiber surface treatment agents and reinforced plastic laminate treatment agents. The coupling agent A-151 is vinyl triethoxysilane with a molecular formula of $CH_2{=}CHSi(OCH_2CH_3)_3$, soluble in organic solvents, insoluble in water of pH=7, suitable for polymer such as polyethylene, polypropylene, unsaturated polyester, as well as glass fiber, plastic, glass, cable, ceramics, etc. The coupling agent A-171 is vinyl trimethoxysilane with a molecular formula of $CH_2{=}CHSi(OCH_3)_3$, a colorless transparent liquid with a density of 0.95-0.99 g/cm$^3$, a refractive index of 1.38-1.40 and a boiling point of 123° C. It has the functions of coupling agent and cross-linking agent, and is suitable for polymer such as polyethylene, polypropylene, unsaturated polyester, and is commonly used in glass fiber, plastic, glass, cable, ceramic, rubber and so on. The coupling agent KH-550 is γ-aminopropyltriethoxysilane, corresponding to the grade A-1100 (USA), has a density of 0.942 g/ml, a melting point of −70° C., a boiling point of 217° C., a refractive index of 1.42-1.422, and a flash point of 96° C. It is applied to mineral-filled thermoplastic and thermosetting resins such as phenolic, polyester, epoxy, PBT, polyamide, carbonate, which can greatly improve the physical and mechanical properties such as dry-wet flexural strength, compressive strength, and shear strength and wet electrical properties of the reinforced plastics, and improve the wettability and dispersibility of the filler in the polymer. The coupling agent KH-560 is γ-glycidoxypropyltrimethoxysilane, corresponding to the grade A-187 (GE), and is commonly used in multi-sulfide and polyurethane caulks and sealants, epoxy resin adhesives, filled or reinforced thermosetting resins, glass fibers or glass reinforced thermoplastic resins. The coupling agent KH-570 is methacryloxysilane, corresponding to the grade A-174 (GE), and the appearance is a colorless or yellowish transparent liquid, which is soluble in acetone, benzene, ether, carbon tetrachloride, and reacts with water. This coupling agent has a boiling point of 255° C., a density of 1.04 g/ml, a refractive index of 1.429, and a flash point of 88° C., which is mainly used for unsaturated polyester resins, and also for polybutene, polyethylene and ethylene propylene diene monomer. The coupling agent KH-580 is γ-mercaptopropyltriethoxysilane, corresponding to the grade A-1891 (USA), a colorless transparent liquid with a special odor, and is easily soluble in various solvents such as ethanol, acetone, benzene, and toluene. This coupling agent is insoluble in water, but is prone to hydrolysis when contacted with water or moisture, and has a boiling point of 82.5° C., a specific gravity of 1.000 (20° C.), a flash point of 87° C., and a molecular weight of 238. The coupling agent KH-590 is γ-mercaptopropyltrimethoxysilane, corresponding to the grade A-189 (USA), has a molecular weight of 196.3399, a density of 1.057 g/ml, a boiling point of 213-215° C., a refractive index of 1.441-1.443 and a flash point of 88° C., and is often used as a glass fiber treating agent and a crosslinking agent. The coupling agent KH-792 is N-β-(aminoethyl)-γ-aminopropyltrimethoxysilane with a molecular formula $NH_2(CH_2)_2NH(CH_2)_3Si(OCH_3)_3$, has a molecular weight of 222, a density of 1.010-1.030 g/ml, a boiling point of 259° C., a refractive index of 1.4425-1.4460, and a flash point of 138° C., and is soluble in organic solvents. The coupling agent KH-902 is γ-aminopropylmethyldiethoxysilane with a molecular formula $NH_2(CH_2)_3SiCH_3(OC_2H_5)_2$, has a molecular weight of 191.34, a density of 0.9160±0.0050 g/ml, a boiling point of 85-88° C./1.07 KPa, and a refractive index of 1.4270±0.0050, and is suitable for most organic and inorganic materials.

In another embodiment of the present invention, there is provided a composite ultra-high molecular weight polyethylene fiber in which glass fiber and graphene are contained, and the glass fiber has a content of 0.2-10 wt %, for example: 0.2 wt %, 0.3 wt %, 0.5 wt %, 0.7 wt %, 0.9 wt %, 1 wt %, 2 wt %, 3 wt %, 4 wt %, 5 wt %, 6 wt %, 7 wt %, 8 wt %, 9 wt %, 10 wt %; preferably 1 to 6 wt %, for example: 1 wt %, 1.2 wt %, 1.5 wt %, 1.8 wt %, 2 wt %, 2.3 wt %, 2.5 wt %, 3 wt %, 3.5 wt %, 3.7 wt %, 4 wt %, 4.5 wt %, 4.8 wt %, 5 wt %, 5.1 wt %, 5.5 wt %, 5.7 wt %, 6 wt %. The graphene accounts for 0.01 wt % to 3 wt %, such as 0.01 wt %, 0.05 wt %, 0.1 wt %, 0.3 wt %, 0.5 wt %, 0.6 wt %, 0.7 wt %. 0.8 wt %, 0.9 wt %, 1 wt %, 1.2 wt %, 1.4 wt %, 1.6 wt %, 1.8 wt %, 2 wt %, 2.2 wt %, 2.4 wt %, 2.6 wt %, 2.8 wt %, 3 wt %; preferably 0.05 wt %, of the composite ultra-high molecular weight polyethylene fiber. The glass fiber referred to herein is interpreted in a broad sense, including narrowly defined glass fiber, as well as glass fiber treated with some modification methods.

According to a preferred embodiment of the present invention, the glass fiber has a diameter of 3-10 μm, for example: 3 μm, 4 μm, 5 μm, 6 μm, 7 μm, 8 μm, 9 μm, 10 μm; preferably 5-7 μm, for example: 5 μm, 5.5 μm, 5.7 μm, 6 μm, 6.2 μm, 6.5 μm, 6.8 μm, 7 μm. The glass fiber has an average length of 30-100 μm, for example: 30 μm, 32 μm, 35 μm, 40 μm, 45 μm, 48 μm, 50 μm, 55 μm, 59 μm, 60 μm, 65 μm, 70 μm, 75 μm, 80 μm, 82 μm, 85 μm, 88 μm, 90 μm, 95 μm, 100 μm; preferably 50-70 μm, for example: 50 μm, 52 μm, 53 μm, 55 μm, 57 μm, 59 Mm, 60 μm, 61 μm, 63 μm, 65 μm, 66 μm, 68 μm, 70 μm. The glass fiber has a length in the range of 10 to 600 μm, for example, 10-500 μm, 20-550 μm, 50-200 μm, 30-60 μm, 35-150 μm, 40-400 μm, 60-300 μm, 55-350 μm, 80-150 μm; preferably 50-400 μm, for example: 50-300 μm, 60-200 μm, 60-400 μm, 50-100 μm, 70-150 μm.

According to a preferred embodiment of the present invention, the graphene may use a graphene powder having a single-layer or multi-layer structure. Preferably, the single-layer or multi-layer structure graphene may have a sheet diameter of 0.5-5 μm, for example: 0.5 μm, 1 μm, 1.5 μm, 2 μm, 2.5 μm, 3 μm, 3.5 μm, 4 μm, 4.5 μm, 5 μm; and a thickness of 0.5-30 nm, for example: 0.5 nm, 5 nm, 10 nm, 15 nm, 20 nm, 25 nm, 30 nm. More preferably, the single-layer or multi-layer structure graphene has a specific surface area of 200-1000 $m^2/g$, for example: 200 $m^2/g$, 300 $m^2/g$, 400 $m^2/g$, 500 $m^2/g$, 600 $m^2/g$, 700 $m^2/g$, 800 $m^2/g$, 900 $m^2/g$, 1000 $m^2/g$.

According to a preferred embodiment of the present invention, the UHMWPE may have a viscosity average molecular weight of $(2\text{-}6)\times10^6$ g/mol, for example: $2\times10^6$ g/mol, $3\times10^6$ g/mol, $4\times10^6$ g/mol, $5\times10^6$ g/mol, $6\times10^6$ g/mol; preferably $(4\text{-}5)\times10^6$ g/mol.

In another embodiment of the present invention, a composite ultra-high molecular weight polyethylene fiber is provided, which is prepared by the method provided by the above two method embodiments.

In the preparation method disclosed by the invention, liquid-liquid (glass fiber premix and graphene slurry premix) is mixed, and then swelled together with UHMWPE in white oil, and then made into a gel-spun. The spinning technology adopts the simplest technology in the tradition, and the equipment requirements are not high. The cut resistance of the graphene composite UHMWPE fiber obtained by this method is obviously improved. Further, the method of the invention also applies the coupling agent to the glass fiber for grafting treatment to obtain a grafted glass fiber, and then which is used to fill and modify the UHMWPE, and then the grapheme is added thereto to enhance. Therefore, the method of the present invention not only can solve the problem of poor dispersion of glass fiber in the case of high viscoelasticity of ultra-high molecular weight polyethylene, but also effectively improve the cut resistance of UHMWPE fiber on the basis of ensuring the flexibility of the yarn.

The invention adopts a mixture of graphene-anhydrous ethanol as a precursor, and first grinds to make the graphene particle size reach D99<7 μm, and then premixes with a small amount of UHMWPE in white oil, wherein the small amount of UHMWPE is as a dispersing agent. The graphene is homogeneously dispersed in the white oil to obtain a graphene slurry premix. In the preparation of the spinning mixture, the graphene slurry premix and the glass fiber premix are first mixed to homogeneously disperse the graphene and the glass fiber into the small amount of UHMWPE matrix, and the graphene is coated on the surface of the glass fiber, thereby effectively enhancing the dispersion of the graphene in the spinning mixture. During the swelling process, a small amount of UHMWPE connected to the graphene-coated glass fiber and a large amount of UHMWPE in the dispersion simultaneously swell, and the glass fiber coated with graphene is homogeneously interwoven into the swollen UHMWPE. Therefore, the graphene in the result fiber is very homogeneous, and the viscosity of the spinning mixture is small, the efficiency of spinning is higher, the hole is not easily blocked, and the problem of adding graphene to increase the viscosity of the spinning mixture is avoided.

In the method disclosed by the invention, the glass fiber obtained by the surface treatment method of the coupling agent is excellent in abrasion resistance, and is more compatible with UHMWPE and the oily solvent, which improves the homogeneous dispersion of the glass fiber in the UHMWPE fiber. Compared with untreated glass fiber, the glass fiber modified by the coupling agent has a significant enhancement of its lipophilic and hydrophobic properties (see FIGS. 1-4).

Figure 5:
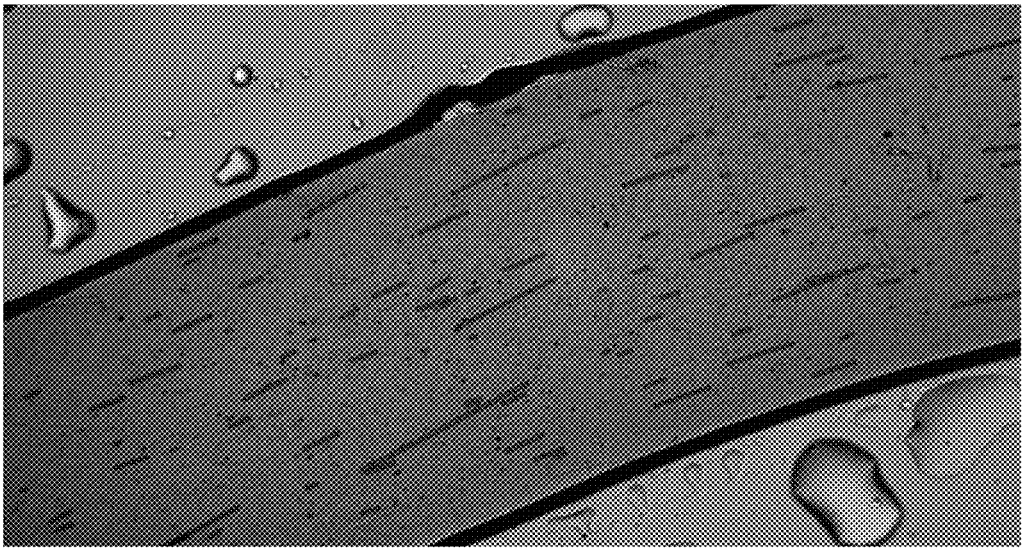
FIG. 5 is an optical microscope image (magnification 5 times) of the gel-spun, wherein the rod is glass fiber and the black particles are graphene.
Figure 6:
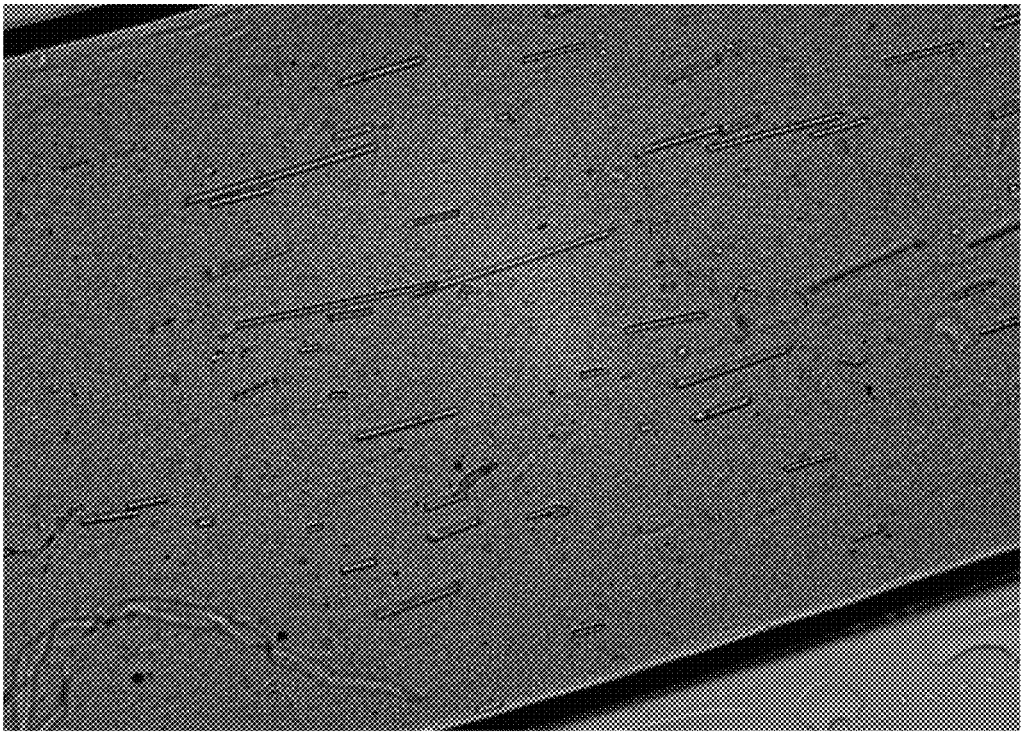
FIG. 6 is an optical microscope image (magnification 10 times) of the gel-spun, wherein the rod is glass fiber and the black particles are graphene.
Figure 7:
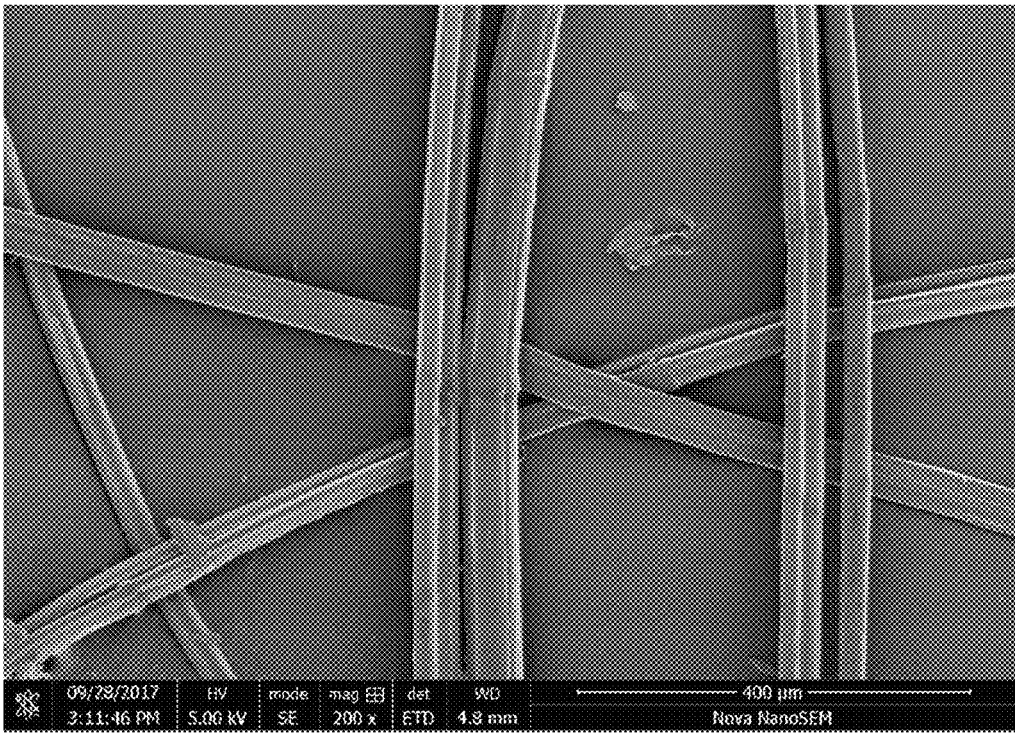
FIG. 7 is a SEM microtopography of the outer surface of the composite fiber.
Figure 8:
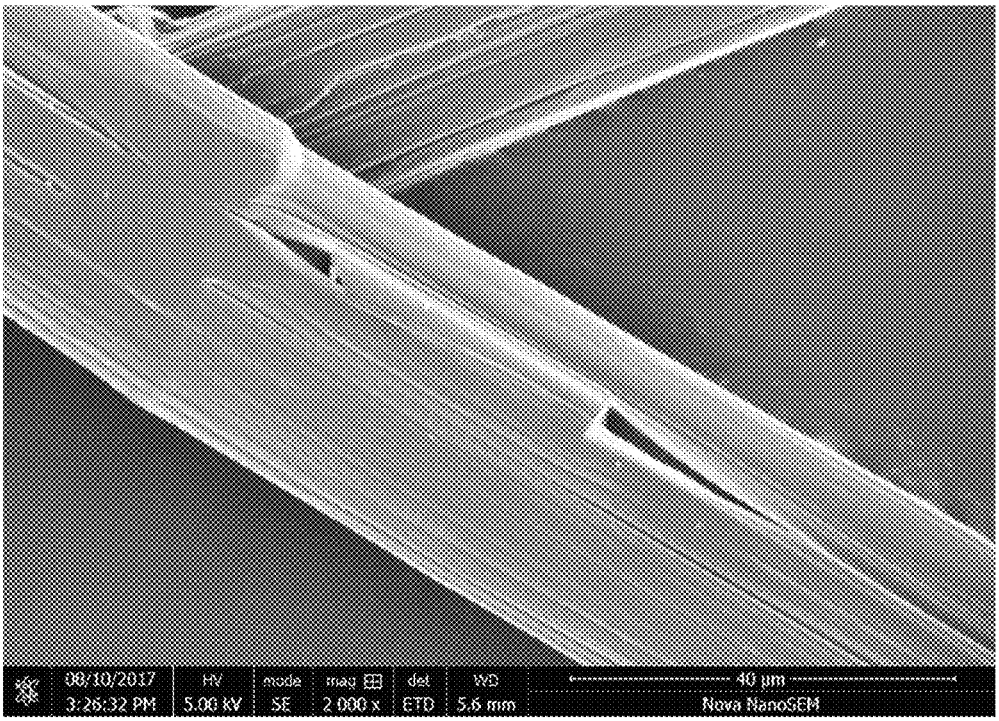
FIG. 8 is a SEM microtopography of the outer surface of the composite fiber.
Figure 9:
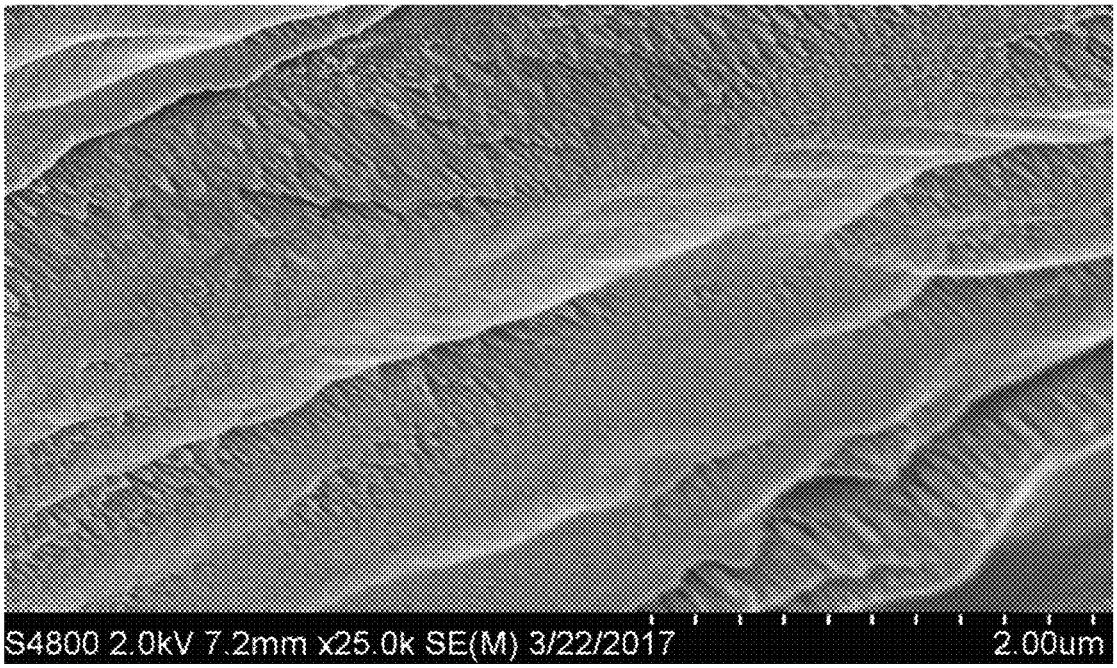
FIG. 9 is a SEM microtopography of the cross-sectional of the composite fiber.
Figure 10:
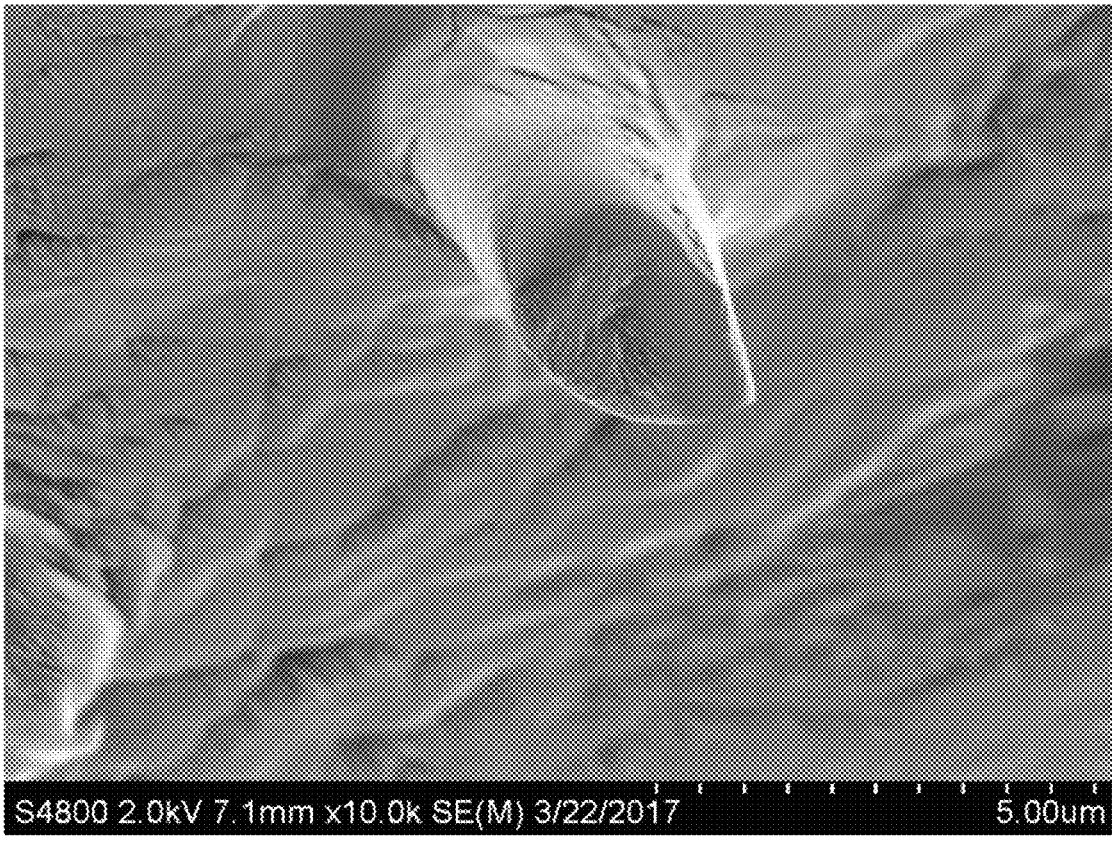
FIG. 10 is a SEM microtopography of the cross-sectional of the composite fiber.
Figure 11:
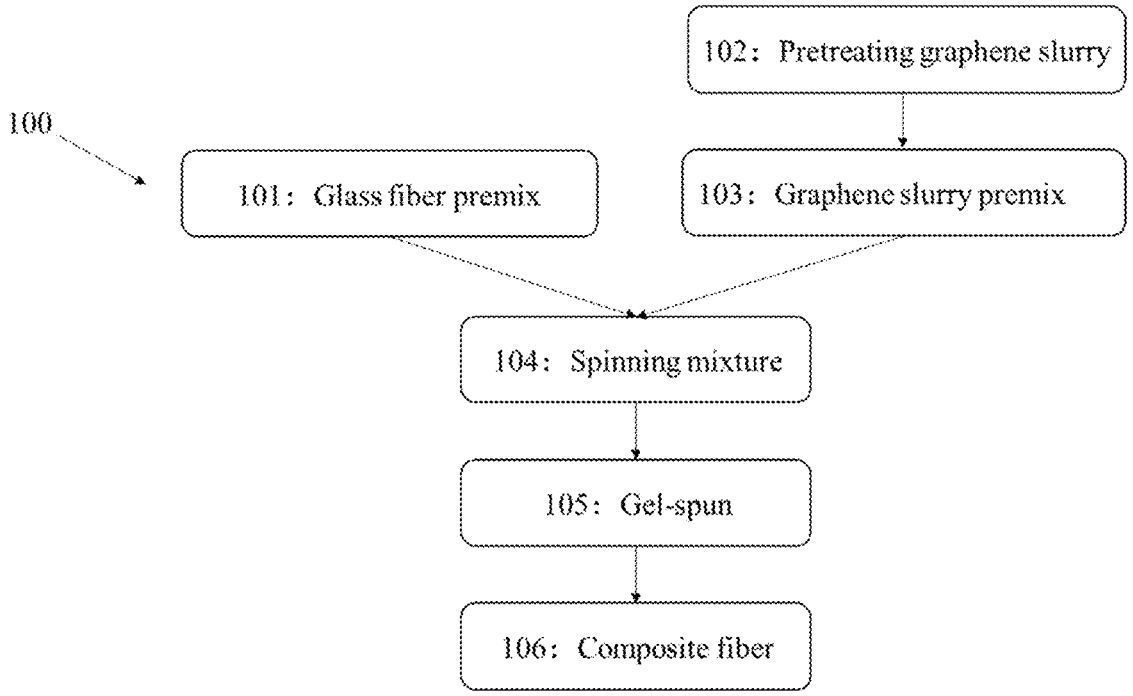
FIG. 11 is a flow chart showing an embodiment of a method for preparing a composite ultra-high molecular weight polyethylene fiber disclosed in the present invention.
Figure 12:
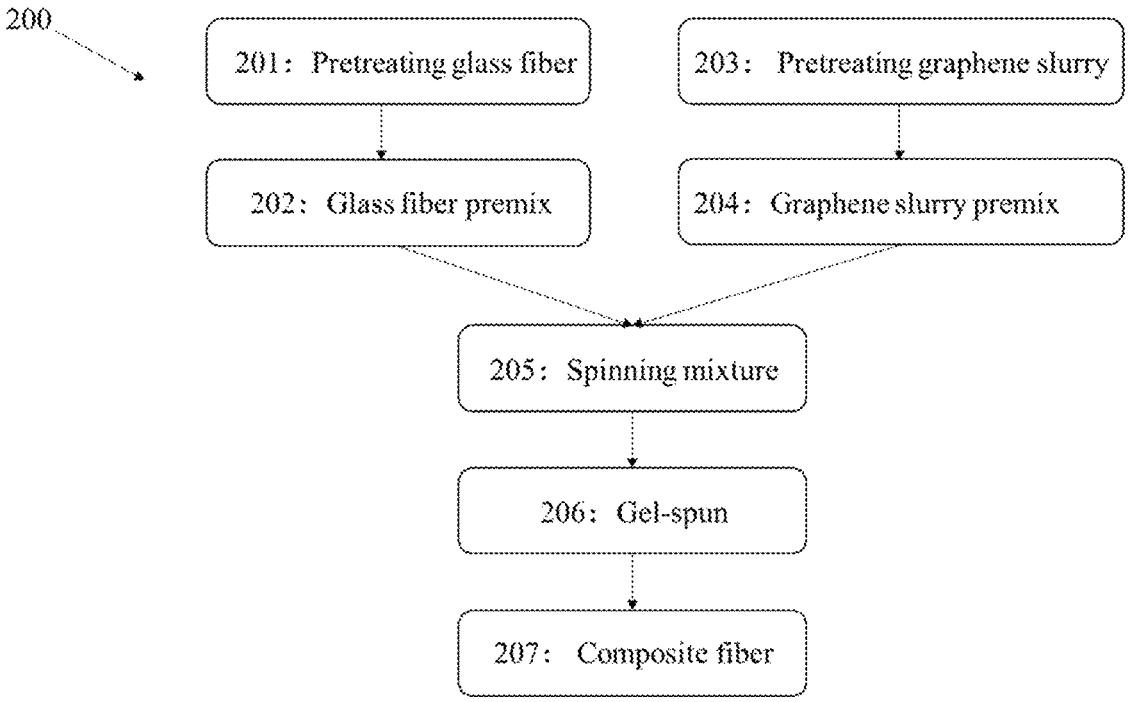
FIG. 12 is a flow chart showing another embodiment of a method for preparing a composite ultra-high molecular weight polyethylene fiber disclosed in the present invention.

The gel-spun prepared by the method of the invention can be observed by the optical microscope, and it can be seen that the graphene and the glass fiber are homogeneously dispersed in the gel-spun, and no large agglomeration is present, which can reflect the dispersion of them in the final composite fiber (See FIGS. 5-6). In addition, from the electron micrograph of the outer surface of the composite fiber, it can be seen that the yams of the composite fiber each has uniform thickness, wherein the glass fiber is entangled with the polymer matrix, and is closely fitted with it, and thus has good compatibility (see FIGS. 7-8). The fiber cross section was prepared using an ultra-low temperature ion milling process, see FIGS. 9-10. From the cross section, it can be seen that the ultra-high molecular weight polyethylene substrate is tightly wrapped with glass fiber, which form an effective and firm interface bond. This is due to the long-chain molecules (ester acyl groups, long-chain alkyl groups, etc.) having a stable organophilic group on the surface of the modified glass fiber. It can diffuse and dissolve at the interface of the polymer, entangle and react with the polymer and thus have good compatibility with the polymer matrix, thereby improving the wettability between the fiber and the polyethylene, and improving the interfacial bonding strength between the interfaces.

In addition, the new process adopted by the invention does not change the traditional gel-spun process, and the preparation process is simple, and the production cost only increases the process of the glass fiber oleophilic modification, and the cost performance is high.

The preferred examples of the present invention are described below in conjunction with the accompanying drawings. It should be understood that the preferred examples described herein are only used to illustrate and explain the present invention and are not intended to limit the present invention.

The graphene used in the following examples is a graphene powder having a single-layer or multi-layer structure, which has a sheet diameter of 0.5-5 μm, a thickness of 0.5-30 nm, and a specific surface area of 200 to 1000 $m^2/g$.

Example 1

Figure 13:
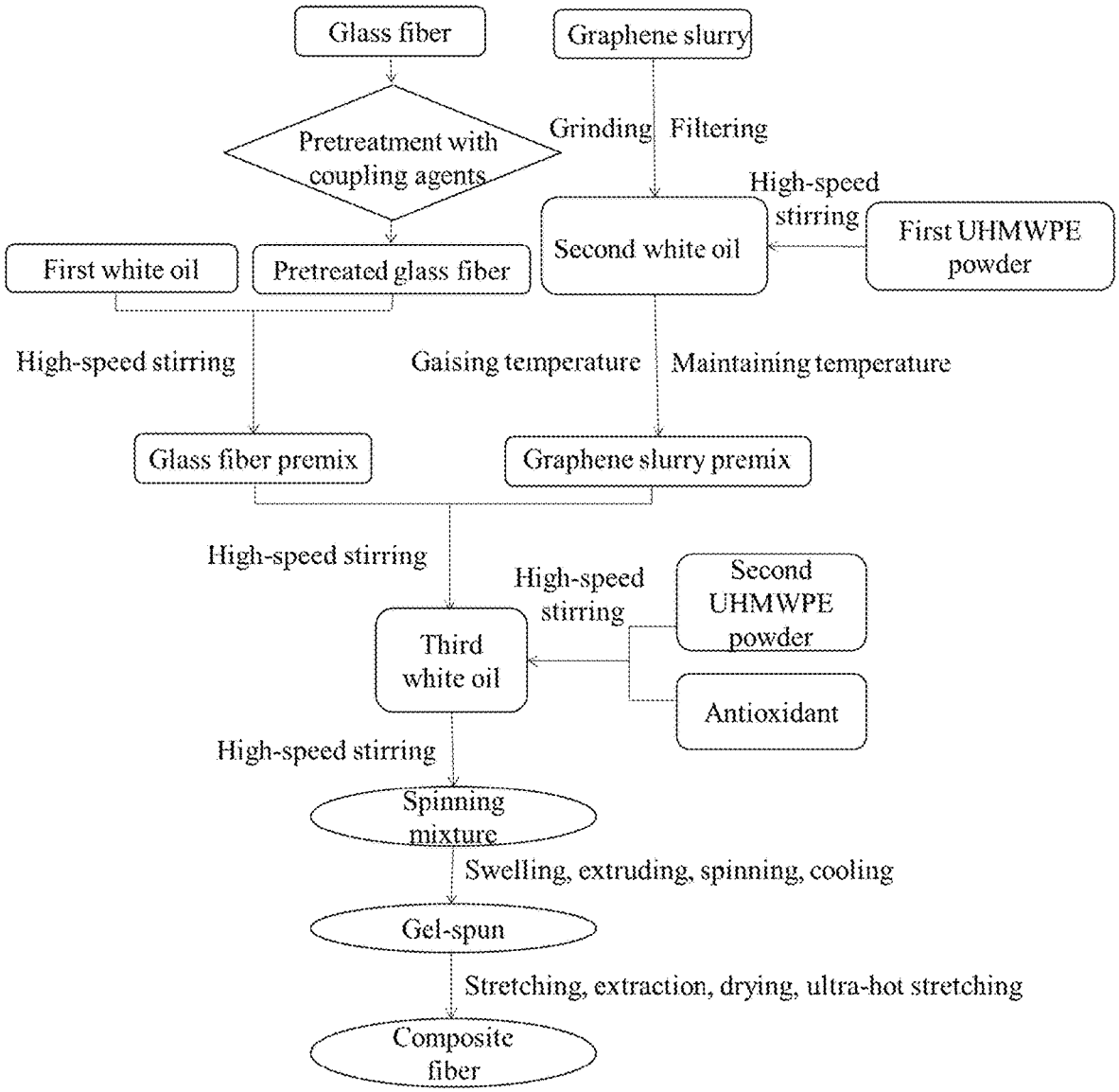
FIG. 13 is a specific process road diagram in an embodiment of the present invention.

As shown in FIG. 13, a method for preparing a composite ultra-high molecular weight polyethylene fiber is provided.

1) Pretreatment of Glass Fiber 0.03 kg of silane coupling agent KH-550 was dissolved in anhydrous ethanol, then 3 kg of glass fiber (having a diameter of 5-7 μm, a length of 50-400 μm, an average length of 70 μm) was added to mix homogeneously, in which KH-550 accounted for 1 wt % of the glass fiber. After 30 min of immersion, the glass fiber was dried at 120° C. for 2 h, and ground and filtered by 100 mesh for subsequent use.

2) Preparation of Glass Fiber Premix

The treated glass fiber was poured into 9 kg of white oil (the concentration of glass fiber is 25%) to mix, and then stirred at a high speed for 15 min with an emulsifier at a speed of 3500 rpm.

3) Pretreatment of Graphene Slurry 0.05 kg of graphene was added to 0.95 kg of anhydrous ethanol and mixed and stirred, and then the mixture was ground in a sand mill until the graphene had a particle size of D99<7 discharged, and suction filtered.

4) Preparation of Graphene Slurry Premix

The above filter residue was added to 0.95 kg of white oil (graphene concentration of 5 wt % in the graphene slurry premix). 0.002 kg of UHMWPE powder (UHMWPE addition amount is 0.2 wt % of graphene slurry premix) was added thereto under high-speed stirring (2000 rpm for 10 min), and the temperature was raised to 80° C. to remove the ethanol. After the solution was not bubbled, the temperature was raised to 150° C. and maintained for 3 h.

5) Preparation of Spinning Mixture

The solutions of steps 2) and 4) were mixed and added to a swelling kettle containing 96.75 kg of UHMWPE powder (viscosity average molecular weight of $5\times10^6$ g/mol) and 1515.75 kg of white oil (glass fiber accounted for 3% of the mass of ultra-high molecular weight polyethylene fibers and the graphene accounted for 0.05% of the mass of the ultra-high molecular weight polyethylene fiber), and then the above mixture was added 0.2 kg of antioxidant 1076 (the amount of antioxidant added was 0.2% of the mass of ultra-high molecular weight polyethylene fiber) and stirred at high speed for 15 min with an emulsifier to prepare the spinning mixture with a certain concentration.

6) Preparation of Composite Fiber

The temperature in the kettle was raised to 110° C. to swell and incubated for 2 h. Further, the mixture was subjected to a dissolution kettle, a feed kettle, and was extruded by a twin-screw extruder to be in a molten state, wherein the extrusion temperature is raised stepwise from 110° C. to 243° C., and then flowed through the metering pump (28 rpm). After metered homogeneously, the gel-spun was formed by cooling with water. After standing and equilibrating for 24 h at room temperature, the gel-spun was subjected to extraction, drying, and 4-stage ultra-hot stretching at a temperature of 140-146° C. to obtain the composite fiber.

Example 2

As shown in FIG. 13, a method for preparing a composite ultra-high molecular weight polyethylene fiber is provided.

1) Pretreatment of Glass Fiber 6 g of silane coupling agent KH-560 was dissolved in anhydrous ethanol, then 6 kg of glass fiber (having a diameter of 3-7 μm, a length of 10-400 μm, an average length of 60 μm) was added to mix homogeneously, in which KH-560 accounted for 0.1 wt % of the glass fiber. After 10 min of immersion, the glass fiber was dried at 180° C. for 1 h, and ground and filtered by 100 mesh for subsequent use.

2) Preparation of Glass Fiber Premix

The treated glass fiber was poured into 114 kg of white oil (the concentration of glass fiber is 5%) to mix, and then stirred at a high speed for 30 min with an emulsifier at a speed of 5000 rpm.

3) Pretreatment of Graphene Slurry 0.01 kg of graphene was added to 0.99 kg of anhydrous ethanol and mixed and stirred, and then the mixture was ground in a sand mill until the graphene had a particle size of D99<7 μm, discharged, and suction filtered.

4) Preparation of Graphene Slurry Premix

The above filter residue was added to 0.99 kg of white oil (graphene concentration of 1 wt % in the graphene slurry premix). 0.001 kg of UHMWPE powder (UHMWPE addition amount is 0.1 wt % of graphene slurry premix) was added thereto under high-speed stirring (1800 rpm for 20 min), and the temperature was raised to 90° C. to remove the ethanol. After the solution was not bubbled, the temperature was raised to 135° C. and maintained for 4.5 h.

5) Preparation of Spinning Mixture

The solutions of steps 2) and 4) were mixed and added to a swelling kettle containing 93.49 kg of UHMWPE powder (viscosity average molecular weight of $4\times10^6$ g/mol) and 1464.68 kg of white oil (glass fiber accounted for 6% of the mass of ultra-high molecular weight polyethylene fiber and the graphene accounted for 0.01% of the mass of the ultra-high molecular weight polyethylene fiber), and then the above mixture was added 0.5 kg of antioxidant DNP (the amount of antioxidant added was 0.5% of the mass of ultra-high molecular weight polyethylene fiber) and stirred at high speed for 15 min with an emulsifier to prepare the spinning mixture with a certain concentration.

6) Preparation of Composite Fiber

The temperature in the kettle was raised to 100° C. to swell and incubated for 3 h. Further, the mixture was subjected to a dissolution kettle, a feed kettle, and was extruded by a twin-screw extruder to be in a molten state, wherein the extrusion temperature is raised stepwise from 110° C. to 243° C., and then flowed through the metering pump (28 rpm). After metered homogeneously, the gel-spun was formed by cooling with water. After standing and equilibrating for 24 h at room temperature, the gel-spun was subjected to extraction, drying, and 4-stage ultra-hot stretching at a temperature of 140-146° C. to obtain the composite fiber.

Example 3

As shown in FIG. 13, a method for preparing a composite ultra-high molecular weight polyethylene fiber is provided.

1) Pretreatment of Glass Fiber 0.02 kg of silane coupling agent KH-570 was dissolved in anhydrous ethanol, then 0.2 kg of glass fiber (having a diameter of 3-10 μm, a length of 10-600 an average length of 30 μm) was added to mix homogeneously, in which KH-570 accounted for 10 wt % of the glass fiber. After 2 h of immersion, the glass fiber was dried at 50° C. for 6 h, and ground and filtered by 100 mesh for subsequent use.

2) Preparation of Glass Fiber Premix

The treated glass fiber was poured into 1.8 kg of white oil (the concentration of glass fiber is 10%) to mix, and then stirred at a high speed for 1 h with an emulsifier at a speed of 3000 rpm.

3) Pretreatment of Graphene Slurry 0.08 kg of graphene was added to 0.92 kg of anhydrous ethanol and mixed and stirred, and then the mixture was ground in a sand mill until the graphene had a particle size of D99<7 discharged, and suction filtered.

4) Preparation of Graphene Slurry Premix

The above filter residue was added to 0.92 kg of white oil (graphene concentration of 8 wt % in the graphene slurry premix). 0.001 kg of UHMWPE powder (UHMWPE addition amount is 0.3 wt % of graphene slurry premix) was added thereto under high-speed stirring (2000 rpm for 5 min), and the temperature was raised to 90° C. to remove the ethanol. After the solution was not bubbled, the temperature was raised to 170° C. and maintained for 2.5 h.

5) Preparation of Spinning Mixture

The solutions of steps 2) and 4) were mixed and added to a swelling kettle containing 98.72 kg of UHMWPE powder (viscosity average molecular weight of $2\times10^6$ g/mol) and 1546.61 kg of white oil (glass fiber accounted for 0.2% of the mass of ultra-high molecular weight polyethylene fibers and the graphene accounted for 0.08% of the mass of the ultra-high molecular weight polyethylene fiber), and then the above mixture was added 1 kg of antioxidant CA (the amount of antioxidant added was 1% of the mass of ultra-high molecular weight polyethylene fiber) and stirred at high speed for 15 min with an emulsifier to prepare the spinning mixture with a certain concentration.

6) Preparation of Composite Fiber

The temperature in the kettle was raised to 140° C. to swell and incubated for 1 h. Further, the mixture was subjected to a dissolution kettle, a feed kettle, and was extruded by a twin-screw extruder to be in a molten state, wherein the extrusion temperature is raised stepwise from 110° C. to 243° C., and then flowed through the metering pump (28 rpm), after metered homogeneously, the gel-spun was formed by cooling with water. After standing and equilibrating for 24 h at room temperature the gel-spun was subjected to extraction, drying, and 4-stage ultra-hot stretching at a temperature of 140-146° C. to obtain the composite fiber.

Example 4

As shown in FIG. 13, a method for preparing a composite ultra-high molecular weight polyethylene fiber is provided.

1) Pretreatment of Glass Fiber 1 kg of silane coupling agent KH-570 was dissolved in anhydrous ethanol, then 10 kg of glass fiber (having a diameter of 3-10 μm, a length of 10-600 an average length of 30 μm) was added to mix homogeneously, in which KH-570 accounted for 10 wt % of the glass fiber. After 2 h of immersion, the glass fiber was dried at 50° C. for 6 h, and ground and filtered by 100 mesh for subsequent use.

2) Preparation of Glass Fiber Premix

The treated glass fiber was poured into 1.8 kg of white oil (the concentration of glass fiber is 30%) to mix, and then stirred at a high speed for 5 min with an emulsifier at a speed of 10000 rpm.

3) Pretreatment of Graphene Slurry 0.03 kg of graphene was added to 0.97 kg of anhydrous ethanol and mixed and stirred, and then the mixture was ground in a sand mill until the graphene had a particle size of D99<7 μm, discharged, and suction filtered.

4) Preparation of Graphene Slurry Premix

The above filter residue was added to 0.97 kg of white oil (graphene concentration of 3 wt % in the graphene slurry premix). 0.002 kg of UHMWPE powder (UHMWPE addition amount is 0.2 wt % of graphene slurry premix) was added thereto under high-speed stirring (2000 rpm for 10 min), and the temperature was raise to 85° C. to remove the ethanol. After the solution was not bubbled, the temperature was raised to 150° C. and maintained for 3 h.

5) Preparation of Spinning Mixture

The solutions of steps 2) and 4) were mixed and added to a swelling kettle containing 89.87 kg of UHMWPE powder (viscosity average molecular weight of $6\times10^6$ g/mol) and 1407.9 kg of white oil (glass fiber accounted for 10% of the mass of ultra-high molecular weight polyethylene fibers and the graphene accounted for 3% of the mass of the ultra-high molecular weight polyethylene fiber), and then the above mixture was added 0.1 kg of antioxidant 1076 (the amount of antioxidant added was 0.1% of the mass of ultra-high molecular weight polyethylene fiber) and stirred at high speed for 15 min with an emulsifier to prepare the spinning mixture with a certain concentration.

6) Preparation of Composite Fiber

The temperature in the kettle was raised to 120° C. to swell and incubated for 2 h. Further, the mixture was subjected to a dissolution kettle, a feed kettle, and was extruded by a twin-screw extruder to be in a molten state, wherein the extrusion temperature is raised stepwise from 110° C. to 243° C., and then flowed through the metering pump (28 rpm). After metered homogeneously, the gel-spun was formed by cooling with water. After standing and equilibrating for 24 h at room temperature, the gel-spun was subjected to extraction, drying, and 4-stage ultra-hot stretching at a temperature of 140-146° C. to obtain the composite fiber.

Example 5

As shown in FIG. 13, a method for preparing a composite ultra-high molecular weight polyethylene fiber is provided.

1) Pretreatment of Glass Fiber 0.05 kg of silane coupling agent KH-560 was dissolved in anhydrous ethanol, then 1 kg of glass fiber (having a diameter of 3-10 μm, a length of 50-600 an average length of 85 μm) was added to mix homogeneously, in which KH-560 accounted for 5 wt % of the glass fiber. After 1 h of immersion, it was dried at 130° C. for 2 h, and ground and filtered by 100 mesh for subsequent use.

2) Preparation of Glass Fiber Premix

The treated glass fiber was poured into 19 kg of white oil (the concentration of glass fiber is 20%), and then stirred at a high speed for 10 min with an emulsifier at a speed of 8000 rpm.

3) Pretreatment of Graphene Slurry 0.05 kg of graphene was added to 0.95 kg of anhydrous ethanol and mixed and stirred, and then the mixture was ground in a sand mill until the graphene had a particle size of D99<7 discharged, and suction filtered.

4) Preparation of Graphene Slurry Premix

The above filter residue was added to 0.95 kg of white oil (graphene concentration of 5 wt % in the graphene slurry premix). 0.002 kg of UHMWPE powder (UHMWPE addition amount is 0.2 wt % of graphene slurry premix) was added thereto under high-speed stirring (2000 rpm for 10 min), and the temperature was raised to 85° C. to remove the ethanol. After the solution was not bubbled, the temperature was raised to 150° C. and maintained for 3 h.

5) Preparation of Spinning Mixture

The solutions of steps 2) and 4) were mixed and added to a swelling kettle containing 98.75 kg of UHMWPE powder (viscosity average molecular weight of $3\times10^6$ g/mol) and 1547.08 kg of white oil (glass fiber accounted for 1% of the mass of ultra-high molecular weight polyethylene fibers and the graphene accounted for 0.05% of the mass of the ultra-high molecular weight polyethylene fiber), and then the above mixture was added 0.2 kg of antioxidant 1076 (the amount of antioxidant added was 0.2% of the mass of ultra-high molecular weight polyethylene fiber) and stirred at high speed for 15 min with an emulsifier to prepare the spinning mixture with a certain concentration.

6) Preparation of Composite Fiber

The temperature in the kettle was raised to 130° C. to swell and incubated for 2 h. Further, the mixture was subjected to a dissolution kettle, a feed kettle, and was extruded by a twin-screw extruder to be in a molten state, wherein the extrusion temperature is raised stepwise from 110° C. to 243° C., and then flowed through the metering pump (28 rpm). After metered homogeneously, the gel-spun was formed by cooling with water. After standing and equilibrating for 24 h at room, the gel-spun was subjected to extraction, drying, and 4-stage ultra-hot stretching at a temperature of 140-146° C. to obtain the composite fiber.

Example 6

Figure 14:
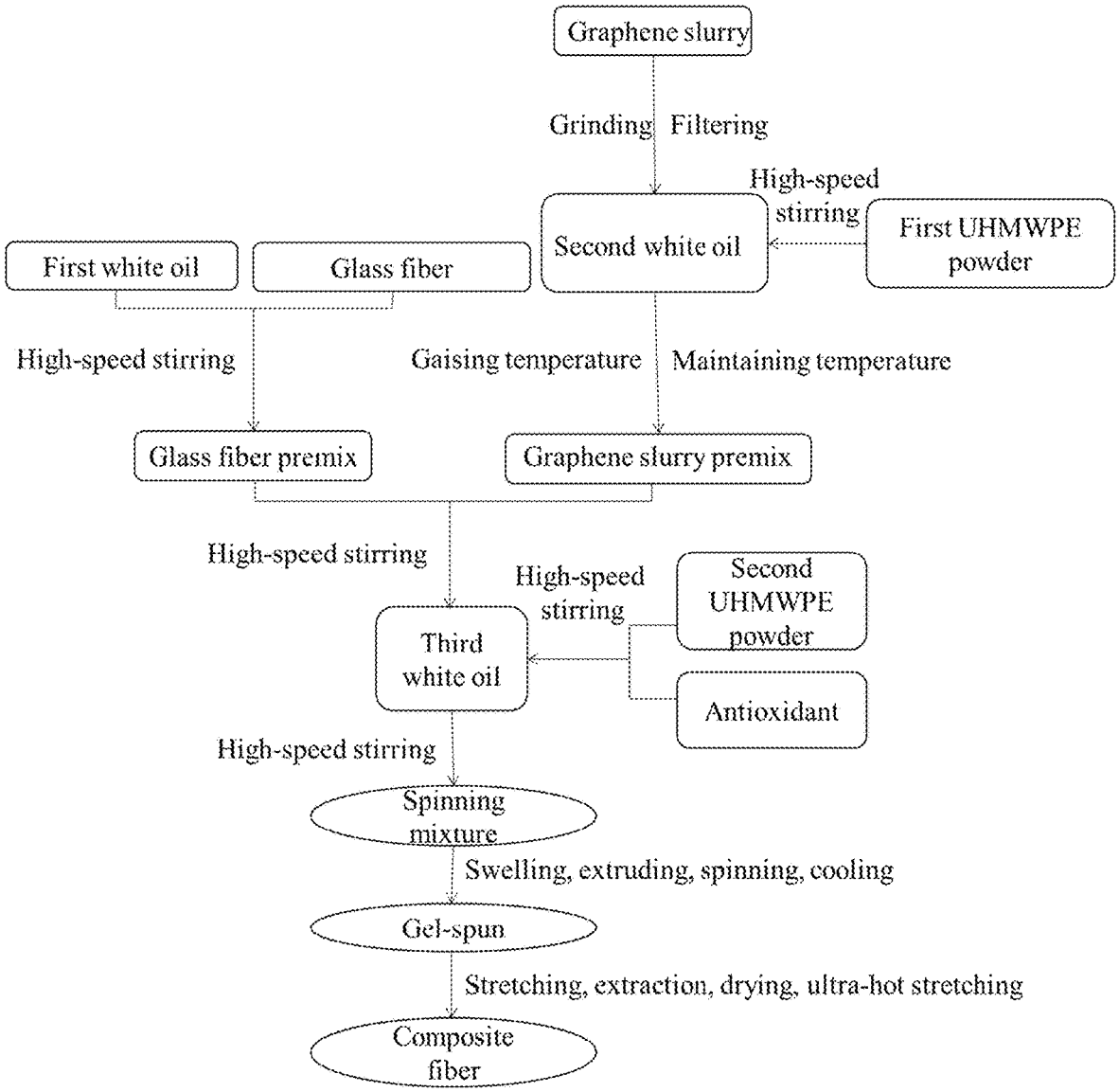
FIG. 14 is another specific process road diagram in an embodiment of the present invention.

As shown in FIG. 14, a method for preparing a composite ultra-high molecular weight polyethylene fiber is provided.

1) Preparation of Glass Fiber Premix 3 kg of glass fiber was poured into 9 kg of white oil (the concentration of glass fiber is 25%), and then stirred at a high speed for 15 min with an emulsifier at a speed of 3500 rpm.

2) Pretreatment of Graphene Slurry 0.05 kg of graphene was added to 0.95 kg of anhydrous ethanol and mixed and stirred, and then the mixture was ground in a sand mill until the graphene had a particle size of D99<7 discharged, and suction filtered.

3) Preparation of Graphene Slurry Premix

The above filter residue was added to 0.95 kg of white oil (graphene concentration of 5 wt % in the graphene slurry premix). 0.002 kg of UHMWPE powder (UHMWPE addition amount is 0.2 wt % of graphene slurry premix) was added thereto under high-speed stirring (2000 rpm for 10 min), and the temperature was raised to 80° C. to remove the ethanol. After the solution was not bubbled, the temperature was raised to 150° C. and maintained for 3 h.

4) Preparation of Spinning Mixture

The solutions of steps 1) and 3) were mixed and added to a swelling kettle containing 96.75 kg of UHMWPE powder (viscosity average molecular weight of $5\times10^6$ g/mol) and 1515.75 kg of white oil (glass fiber accounted for 3% of the mass of ultra-high molecular weight polyethylene fibers and the graphene accounted for 0.05% of the mass of the ultra-high molecular weight polyethylene fiber), and then the above mixture was added 0.2 kg of antioxidant 1076 (the amount of antioxidant added was 0.2% of the mass of ultra-high molecular weight polyethylene fiber) and stirred at high speed for 15 min with an emulsifier to prepare the spinning mixture with a certain concentration.

6) Preparation of Composite Fiber

The temperature in the kettle was raised to 110° C. to swell and incubated for 2 h. Further, the mixture was subjected to a dissolution kettle, a feed kettle, and was extruded by a twin-screw extruder to be in a molten state, wherein the extrusion temperature is raised stepwise from 110° C. to 243° C., and then flowed through the metering pump (28 rpm). After metered homogeneously, the gel-spun was formed by cooling with water. After standing and equilibrating for 24 h at room temperature, the gel-spun was subjected to extraction, drying, and 4-stage ultra-hot stretching at a temperature of 140-146° C. to obtain the composite fiber.

According to the method of the present invention, the cut resistance performance data of the products of the various examples of the present invention are shown in Table 1 below, which shows the expected load capacity and ANSI grade of the composite fibers containing different amounts of glass fiber and graphene prepared by the method of the present invention, wherein the larger the load expected, the higher the strength of the obtained composite fiber, and the higher the ANSI grade, indicating that the cut resistance of the obtained composite fiber is stronger.

TABLE 1

Comparison results of the cutting resistance test of the composite ultra-high molecular weight polyethylene fiber of the present invention

| Product number | Glass fiber addition amount | Graphene addition amount | Expected load | ANSI grade |
|---|---|---|---|---|
| Example 1 | 3% | 0.05% | 1930 g | A4 |
| Example 2 | 6% | 0.01% | 1611 g | A4 |
| Example 3 | 0.2% | 0.08% | 1743 g | A4 |
| Example 4 | 10% | 3% | 2002 g | A4 |
| Example 5 | 1% | 0.05% | 1603 g | A4 |
| Example 6 | 3% | 0.05% | 2106 g | A4 |

It should be noted that the above description is only a preferred embodiment of the present invention and is not intended to limit the present invention. Although the present invention has been described in detail with reference to the foregoing embodiments, those skilled in the art can still modify the technical solutions described in the foregoing embodiments, or equivalently replace some of the technical features. Any modifications, equivalent substitutions, improvements, etc. made within the spirit and scope of the present invention are intended to be included within the scope of the present invention.

The invention claimed is:

1. A method for preparing a composite ultra-high molecular weight polyethylene fiber, comprising:

preparing a glass fiber premix: dispersing glass fiber in a first white oil to obtain the glass fiber premix;

preparing a graphene slurry premix: preparing a graphene slurry, filtering, then adding the filter residue to a second white oil, and then adding a first UHMWPE to the second white oil containing the graphene filter residue to form the graphene slurry premix, heating a temperature of the graphene slurry premix to 80° C. to 90° C., when the graphene slurry premix does not bubble, raising the temperature of the graphene slurry premix to 135° C. to 170° C., and maintaining for 2.5 h to 4.5 h;

preparing a spinning mixture: mixing the glass fiber premix, the graphene slurry premix, a second UHMWPE, an antioxidant, and a third white oil to obtain the spinning mixture;

swelling and mixing the spinning mixture to a molten state;

extruding the molten spinning mixture;

cooling the spinning mixture to form a gel-spun; and obtaining the composite ultra-high molecular weight polyethylene fiber from the gel-spun.

2. The method for preparing the composite ultra-high molecular weight polyethylene fiber according to claim 1, wherein the glass fiber premix contains 5 wt % to 30 wt % of glass fiber, wherein dispersing the glass fiber in the first white oil comprises: first pouring the glass fiber into the first white oil, premixing, and then stirring with an emulsifier to form a homogeneous slurry.

3. The method for preparing the composite ultra-high molecular weight polyethylene fiber according to claim 2, wherein the glass fiber premix containing 10 wt % to 25 wt % of glass fiber and the emulsifier is stirred at a stirring speed of 3000 rpm to 10000 rpm for; a stirring time of 5 min to 60 min.

4. The method for preparing the composite ultra-high molecular weight polyethylene fiber according to claim 1, wherein the swelling and mixing step is carried out by heating the spinning mixture to 100° C. to 140° C. in a swelling kettle and holding for 1 h to 3 h.

5. The method for preparing the composite ultra-high molecular weight polyethylene fiber according to claim 1, wherein the glass fiber has a diameter of 3 μm to 10 μm, the glass fiber has an average length of 30 μm to 100 μm, and the glass fiber has a length in the range of 10 μm to 600 μm.

6. The method for preparing the composite ultra-high molecular weight polyethylene fiber according to claim 1, wherein the glass fiber has a diameter of 5 μm to 7 μm, the glass fiber has an average length of 50 μm to 70 μm, and the glass fiber has a length in the range of 50 μm to 400 μm.

7. The method for preparing the composite ultra-high molecular weight polyethylene fiber according to claim 1, wherein the glass fiber is firstly modified with a silane coupling agent, and then used to prepare the glass fiber premix; the specific treatment method for modifying the glass fiber with the silane coupling agent is as follows: dissolving the silane coupling agent in anhydrous ethanol, and then the glass fiber is added to mix homogeneously, impregnating, drying, grinding, and filtering by 100 mesh; wherein an amount of the silane coupling agent is 0.2% to 2% of a total mass of the glass fiber, and an impregnation time of the glass fiber in the silane coupling agent ethanol solution is 30 min to 2 h, and a drying temperature is 50° C. to 180° C., and a drying time is 2 h to 3 h.

8. The method for preparing the composite ultra-high molecular weight polyethylene fiber according to claim 1, wherein the graphene slurry is a mixture of graphene and anhydrous ethanol containing 1 wt % to 8 wt % of graphene.

9. The method for preparing the composite ultra-high molecular weight polyethylene fiber according to claim 1, wherein the graphene slurry has 5 wt % of graphene, and the graphene is a single-layered or a multi-layered graphene powder, the single-layered or multi-layered graphene has a sheet diameter of 0.5 μm to 5 μm and a thickness of 0.5 nm to 30 nm and a specific surface area of 200 $m^2/g$ to 1000 $m^2/g$.

10. The method for preparing the composite ultra-high molecular weight polyethylene fiber according to claim 1, wherein the graphene slurry is a mixture of graphene and anhydrous ethanol, and when preparing the graphene slurry premix, graphene is grinded to a graphene particle size of D99<7 μm in a sand mill using a grinding medium of zirconia bead having a particle diameter of 0.6 mm to 0.8 mm at a rotation speed of 1500 rpm to 2800 rpm for 3 h to 4 h, wherein the first UHMWPE is added to the second white oil containing the graphene filter residue under stirring at a stirring speed of 1800 rpm to 2000 rpm for 5 min to 20 min.

11. The method for preparing the composite ultra-high molecular weight polyethylene fiber according to claim 1, wherein the graphene slurry premix contains 1 wt % to 8 wt % of graphene and 0.1 wt % to 0.3 wt % of the first UHMWPE.

12. The method for preparing the composite ultra-high molecular weight polyethylene fiber according to claim 1, wherein the graphene slurry premix has 5 wt % of graphene and 0.2 wt % of the first UHMWPE.

13. The method for preparing the composite ultra-high molecular weight polyethylene fiber according to claim 1, wherein, when preparing the spinning mixture, the glass fiber premix and the graphene slurry premix are first mixed in an emulsifier, then added to a swelling kettle containing the second UHMWPE and the third white oil, and the antioxidant is further added to form the spinning mixture, wherein a mass ration between the second UHMWPE and the third white oil is 6:94.

14. The method for preparing the composite ultra-high molecular weight polyethylene fiber according to claim 1, wherein, when preparing the spinning mixture, a mass ratio among the glass fiber in the glass fiber premix, the graphene in the graphene slurry premix, and the antioxidant is (0.2-10):(0.01-3): (0.01-1).

15. The method for preparing the composite ultra-high molecular weight polyethylene fiber according to claim 1, wherein, when preparing the spinning mixture, a mass ratio among the glass fiber in the glass fiber premix, the graphene in the graphene slurry premix, and the antioxidant is (1-6): (0.05):(0.1-0.5).

* * * * *